US009490056B2

(12) United States Patent
Lee et al.

(10) Patent No.: US 9,490,056 B2
(45) Date of Patent: Nov. 8, 2016

(54) COIL COMPONENT AND ELECTRONIC MODULE USING THE SAME

(71) Applicant: SAMSUNG ELECTRO-MECHANICS CO., LTD., Suwon-Si, Gyeonggi-Do (KR)

(72) Inventors: Young Min Lee, Suwon-Si (KR); Geun Young Park, Suwon-Si (KR); Sang Yun Lee, Suwon-Si (KR); Jae Sun Won, Suwon-Si (KR); Suk Hyeon Cho, Suwon-Si (KR); Tae Won Heo, Suwon-Si (KR)

(73) Assignee: SOLUM CO., LTD, Suwon-Si, Gyeonggi-Do (KR)

( * ) Notice: Subject to any disclaimer, the term of this patent is extended or adjusted under 35 U.S.C. 154(b) by 178 days.

(21) Appl. No.: 14/289,302

(22) Filed: May 28, 2014

(65) Prior Publication Data

US 2015/0061817 A1 Mar. 5, 2015

(30) Foreign Application Priority Data

Aug. 30, 2013 (KR) ..... 10-2013-0103966

(51) Int. Cl.

| | |
|---|---|
| ***H01F 17/04*** | (2006.01) |
| ***H01F 5/00*** | (2006.01) |
| ***H01F 17/00*** | (2006.01) |
| ***H01F 17/06*** | (2006.01) |

(52) U.S. Cl.

CPC ..... *H01F 17/0013* (2013.01); *H01F 17/0033* (2013.01); *H01F 17/062* (2013.01)

(58) Field of Classification Search

CPC ..... H01L 23/5227; H01L 23/645; H01L 23/3107; H01L 21/76224; H01F 2007/068; H01F 17/0006; H01F 2017/002; H01F 27/2804; H01F 41/06; H01F 41/046

USPC ..... 336/200, 221, 232

See application file for complete search history.

(56) References Cited

U.S. PATENT DOCUMENTS

| | | | | |
|---|---|---|---|---|
| 3,046,452 | A * | 7/1962 | Gellert | H01F 27/022 174/521 |
| 3,881,244 | A * | 5/1975 | Kendall | G11B 5/17 257/E27.046 |
| 4,451,867 | A * | 5/1984 | Robertson | F42D 1/05 361/248 |
| 4,616,205 | A * | 10/1986 | Praught | H01F 27/2866 336/195 |
| 6,181,130 | B1 | 1/2001 | Hoshi et al. | |
| 6,287,931 | B1 * | 9/2001 | Chen | H01L 21/76224 257/E21.022 |
| 6,492,708 | B2 * | 12/2002 | Acosta | H01F 17/0006 257/421 |

(Continued)

FOREIGN PATENT DOCUMENTS

| | | |
|---|---|---|
| JP | 2985079 B2 | 11/1999 |
| JP | 2011-165709 A | 8/2011 |

(Continued)

*Primary Examiner* — Alexander Talpalatski
*Assistant Examiner* — Joselito Baisa
(74) *Attorney, Agent, or Firm* — McDermott Will & Emery LLP

(57) ABSTRACT

A coil component may include: a base board having an accommodation portion disposed therein and having conductive patterns disposed within the accommodation portion; an annular core disposed in the accommodation portion; and a laminated board laminated on the base board and having conductive patterns disposed on one surface thereof. The conductive patterns of the laminated board are connected to the conductive patterns of the base board to form a coil.

15 Claims, 19 Drawing Sheets

(56) References Cited

U.S. PATENT DOCUMENTS 6,498,557 B2 * 12/2002 Johnson ..... H01F 17/0033 336/200
6,720,230 B2 * 4/2004 Acosta ..... H01F 17/0006 257/E21.022
6,876,554 B1 * 4/2005 Inagaki ..... H01G 4/224 257/E23.062
7,081,803 B2 * 7/2006 Takaya ..... H01F 17/0033 336/200
7,513,031 B2 * 4/2009 Pleskach ..... H01F 17/0033 156/250
7,690,110 B2 * 4/2010 Whittaker ..... H01F 17/0033 174/264
7,821,374 B2 * 10/2010 Harrison ..... H01F 19/04 336/192
7,915,991 B2 * 3/2011 Waffenschmidt ... H01F 27/2804 336/20
7,940,154 B2 * 5/2011 Chow ..... H01F 27/027 336/192
8,470,612 B2 * 6/2013 Hofmann ..... H01F 41/046 257/531
8,547,194 B2 * 10/2013 Tseng ..... H01F 27/027 336/65
2008/0186124 A1 * 8/2008 Schaffer ..... H01F 27/2895 336/200

FOREIGN PATENT DOCUMENTS

KR 10-0421305 B1 4/2004
KR 10-1111189 B1 2/2012

* cited by examiner

D-D

E-E

COIL COMPONENT AND ELECTRONIC MODULE USING THE SAME

CROSS-REFERENCE TO RELATED APPLICATION

This application claims the benefit of Korean Patent Application No. 10-2013-0103966 filed on Aug. 30, 2013, with the Korean Intellectual Property Office, the disclosure of which is incorporated herein by reference.

BACKGROUND

The present disclosure relates to a coil component and an electronic module including the same, and more particularly, to a coil component having a minimal size with a core installed therein and an electronic module including the same.

In general, display devices, printers, as well as other electric and electronic devices commonly employ switching mode power supplies (SMPS) as power supply devices.

An SMPS is a module-type power supply device converting electricity supplied from an external source into an appropriate type of signal for powering various electric or electronic devices such as computers, TVs, VCRs, exchanges (or switching boards), wireless communications devices and the like. Such an SMPS serves to intermittently control output of a voltage frequency higher than a commercial voltage frequency and alleviating impacts by using semiconductor switching characteristics.

Recently, as TVs have increased in size, a large amount of power is required therein. To this end, in order to power a backlight of a large panel, a plurality of coil components (e.g., DC/DC converters) are installed in the SMPS.

In general, a coil component has a structure in which a coil is wound around a bobbin and coil cores are coupled by penetrating the bobbin (holes penetrating through edge portions of respective bobbins). In the case of such a structure, however, since a coil needs to be directly wound around a bobbin, a large amount of time is required for manufacturing.

Also, there may be limitations in reducing an overall thickness and a size of such a structure, and thus, it is difficult to cope with the trend of compactness.

SUMMARY

An aspect of the present disclosure may provide a coil component easy to be manufactured and an electronic module using the same.

An aspect of the present disclosure may also provide a coil component having a minimized size and an electronic module using the same.

According to an aspect of the present disclosure, a coil component includes: a base board having an accommodation portion and conductive patterns disposed within the accommodation portion; an annular shape core disposed in the accommodation portion; and a laminated board laminated onto the base board and having conductive patterns disposed on one surface thereof, wherein the conductive patterns of the laminated board are connected to the conductive patterns of the base board to form a coil.

The base board may include at least one core guide formed within the accommodation portion and defining an insertion position of the core.

The core guide may be disposed on the corner between a side wall of the accommodation portion and a bottom surface of the accommodation portion.

A plurality of core guides may be disposed spaced apart from one another at equal intervals.

The core guide may protrude from the side wall of the accommodation portion or the bottom surface of the accommodation portion.

The core guide may have an 'L' shape.

The core guide may have a shape of which width reduces towards an upper end thereof.

The core guide may protrude between the conductive patterns radially formed on the accommodation portion.

The core may have a gap formed by cutting a portion thereof in a radial direction of the annular shape core.

The base board may include an insertion protrusion formed within the accommodation portion to fix a position of the core gap.

The base board may include at least one core guide defining an insertion position of the core within the accommodation portion, and the insertion protrusion may protrude from the core guide and inserted into the gap of the core.

The coil component may further include a barrier inserted into the gap of the core and coupled within the accommodation portion to fix the core to the accommodation portion.

The base board may include an insertion recess within the accommodation portion and allowing the barrier to be coupled thereto.

According to another aspect of the present disclosure, a coil component may include: a board assembly having an accommodation portion and conductive patterns disposed on an inner surface of the accommodation portion; and a core embedded in the accommodation portion, wherein a core guide is disposed within the accommodation portion to secure a space by which the core is separated from the conductive patterns.

The board assembly may include: a base board having an accommodation portion disposed therein; and a laminated board laminated on the base board to embed the core therein.

The board assembly may include at least one conductive pattern having a coil shape wound around the core.

The board assembly may include at least one external terminal disposed on any one surface thereof, electrically connected to the conductive patterns and electrically and physically connected to the outside.

The interior of the accommodation portion may be filled with an insulating material.

According to another aspect of the present disclosure, a coil component may include: a base board having an accommodation portion and a plurality of through vias disposed on the circumference of the accommodation portion; conductive patterns disposed on an inner surface of the accommodation portion and on a lower surface of the base board; a core disposed in the accommodation portion; a first board laminated on the base board and having conductive patterns disposed on one surface thereof, the conductive patterns being connected to the conductive patterns within the accommodation portion of the base board to form a first coil; and a second board laminated on the first board and having conductive patterns disposed on one surface thereof, the conductive patterns being electrically connected to the through vias of the base board and the conductive patterns disposed on the lower surface of the base board to form a second coil.

The accommodation portion may be an annular recess formed inside the base board of which top surface is exposed, and at least one core guide defining an insertion position of the core may be formed within the accommodation portion.

According to another aspect of the present disclosure, a coil component may include: a base board having an accommodation portion and having a plurality of through vias disposed on the periphery of the accommodation portion; conductive patterns disposed on an inner surface of the accommodation portion and on a lower surface of the base board; a core disposed in the accommodation portion; and a first board laminated on the base board and having conductive patterns disposed on one surface thereof, the conductive patterns being connected to the conductive patterns of the base board.

The base board may have a columnar support portion at the center of the accommodation portion.

The conductive patterns disposed within the accommodation portion may include: first linear conductive patterns disposed on first and second side walls facing one another and a bottom surface, among inner surfaces of the accommodation portion; and second conductive patterns disposed only on the first side wall of the accommodation portion.

The first and second conductive patterns may be alternately disposed in a radial manner, with respect to the support portion.

The base board may further include: connection vias connecting the second conductive patterns and the conductive patterns formed on the lower surface of the base board.

A first coil may be formed by electrically connecting the conductive patterns of the first board, the first and second conductive patterns of the base board, the through vias, the conductive patterns formed on the lower surface of the base board, and the connection vias.

The first coil may include first coil turns formed by the conductive patterns of the first board and the first conductive patterns of the base board; and second coil turns formed along the conductive patterns of the first board, the second conductive patterns of the base board, the connection vias, the conductive patterns formed on the lower surface of the base board, and the through vias of the base board, the first and second coil turns being alternately disposed and connected to form the first coil.

The through vias may be formed within the support portion.

The first coil may include a plurality of coils.

The conductive patterns of the first board may include: first connection patterns electrically connecting the second conductive patterns and the first conductive patterns disposed on the second side wall of the accommodation portion; and second connection patterns electrically connecting the first conductive patterns of the first side wall of the accommodation portion and the through vias.

The first and second connection patterns may be alternately disposed in a radial manner from the center of the first board.

The through vias of the base board may include first and second through vias disposed on the support portion and third through vias disposed on an outer circumference of the accommodation portion.

The coil component may further include: a second board laminated above the first board and having conductive patterns disposed on one surface thereof and electrically connected to the second and third through vias of the base board; and a third board laminated below the base board and having conductive patterns disposed on one surface thereof and electrically connected to the second and third through vias of the base board.

The second and third through vias of the base board, the conductive patterns of the second board, and the conductive patterns of the third board may be electrically connected to form a second coil.

The connection patterns of the first board, the conductive patterns of the base board, and the first through vias of the base board may be electrically connected to form a first coil.

The first coil may include: a primary coil to which a primary side voltage is applied; and an auxiliary coil supplying power induced by the primary coil as a standby power.

At least one of the conductive patterns disposed on the second and third boards may have a width greater than that of the base board or those of the connection patterns formed on the first board.

At least one of the conductive patterns disposed on the third board may have a width increased outwardly, having a fan shape.

The first through vias may be disposed between conductive patterns disposed on the side walls of the support portion of the base board.

The second through vias may be disposed closer to the center of the support portion than the first through vias.

The accommodation portion may an annular recess disposed in the base board of which top surface is exposed, and at least one core guide defining an insertion position of the core may be formed within the accommodation portion.

According to another aspect of the present disclosure, a coil component may include: a base board having an accommodation portion; a core disposed in the accommodation portion; and a laminated board laminated on the base board, wherein a core guide may be disposed within the accommodation portion in order to secure a space by which the core is separated from an inner surface of the accommodation portion.

According to another aspect of the present disclosure, a coil component may include: a base board having a recess shape accommodation portion; an annular core disposed in the accommodation portion and having a gap in a radial direction at a portion thereof; and a laminated board laminated on the base board, wherein an insertion protrusion may be disposed within the accommodation portion and be configured to fix the core to the accommodate portion.

According to another aspect of the present disclosure, a coil component may include: a base board having an accommodation portion; a core disposed in the accommodation portion and having a gap formed by removing a portion thereof; a laminated board laminated on the base board; and a barrier inserted into the gap of the core and fixed to the base board to fix a position of the core.

According to another aspect of the present disclosure, an electronic module may include: a coil component including a board assembly having an accommodation portion and a core disposed in the accommodation portion; and at least one electronic element mounted on one surface of the coil component.

The coil component may have a coil guide disposed within the accommodation portion to secure a space distance between the core and an inner surface of the accommodation portion.

A relay board may be laminated on one surface of the coil component and the electronic element may be mounted on the relay board.

The electronic module may further include a connector fastened to any one surface of the coil component and electrically connected thereto.

The coil component may have a recess formed in at least one surface thereof, and the connector may be inserted into the recess and fastened to the coil component.

According to another aspect of the present disclosure, an electronic module may include: an AC/DC converter including a plurality of electronic elements mounted on a board assembly and converting alternating current (AC) power into direct current (DC) power; and a DC/DC converter including a transformer and converting the converted DC power from the AC/DC converter into an output voltage, wherein the transformer may be embedded within the board assembly.

The electronic module may further include a connector integrally fastened to the board assembly and supplying the DC power from the DC/DC converter to the outside.

According to another aspect of the present disclosure, an electronic module may include: a board assembly; a rectifier mounted on the board assembly or embedded within the board assembly and converting alternating current (AC) power into direct current (DC) power; and a transformer embedded within the board assembly, receiving the DC power from the rectifier, and converting the received DC power into an output voltage.

According to another aspect of the present disclosure, an electronic module may include: a board; an AC/DC converter including a plurality of electronic elements mounted on the board and converting alternating current (AC) power into direct current (DC) power; and a transformer mounted on the board and transforming the converted DC power from the AC/DC conversion unit into an output voltage, wherein a core is embedded within the board assembly.

The electronic elements may be mounted on one surface of the board, and the transformer may be mounted on the other surface of the board.

According to another aspect of the present disclosure, a coil component may include: a base board having an accommodation portion and having a plurality of through vias disposed on the circumference of the accommodation portion; conductive patterns disposed on inner surface of the accommodation portion and on a lower surface of the base board; a core disposed in the accommodation portion; a first board laminated on the base board and having conductive patterns disposed on both surfaces thereof; a first coil including the connective patterns formed on one surface of the first board connected to the conductive patterns within the accommodation portion of the base board; and a second coil including the conductive patterns disposed on the other surface of the first board being electrically connected to the through vias of the base board and the conductive patterns of the lower surface of the base board.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
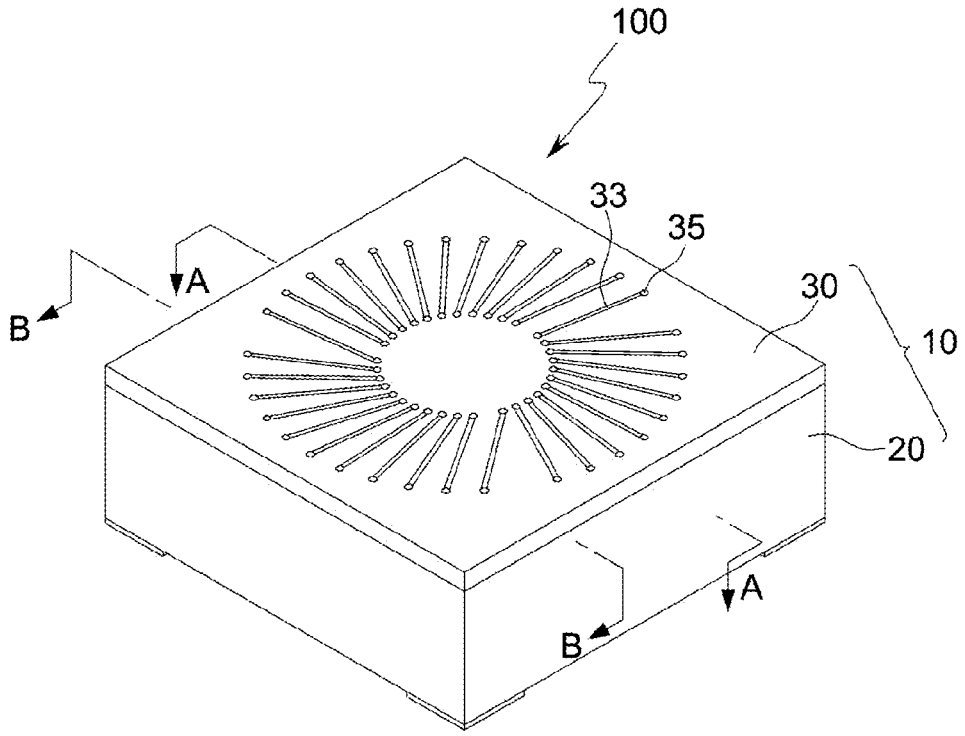
FIG. 1 is a perspective view schematically illustrating a coil component according to an exemplary embodiment of the present disclosure.

Exemplary embodiments of the present disclosure will now be described in detail with reference to the accompanying drawings.

The disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Figure 2:
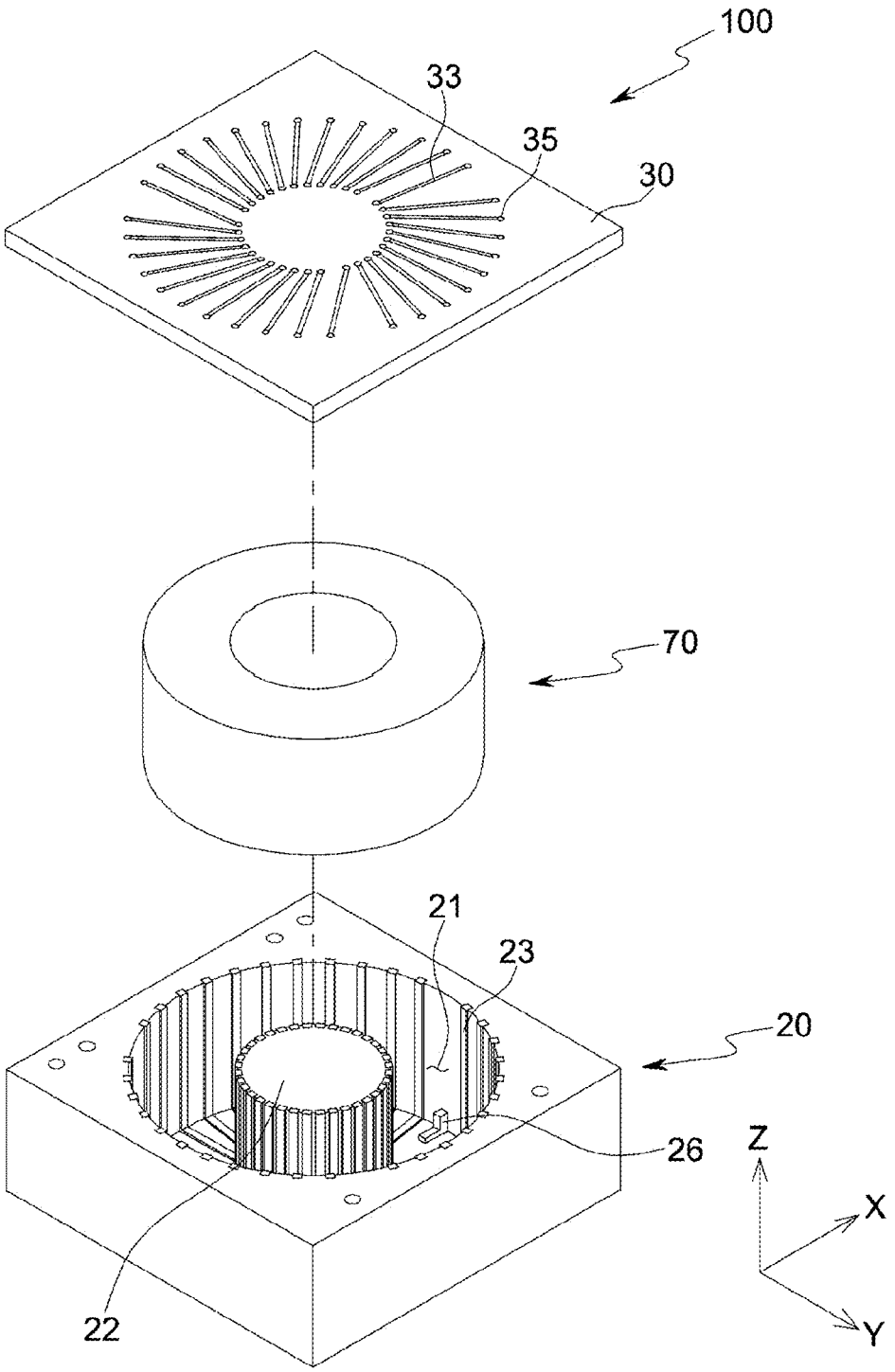
FIG. 2 is an exploded perspective view illustrating the coil component illustrated in FIG. 1.
Figure 3A:
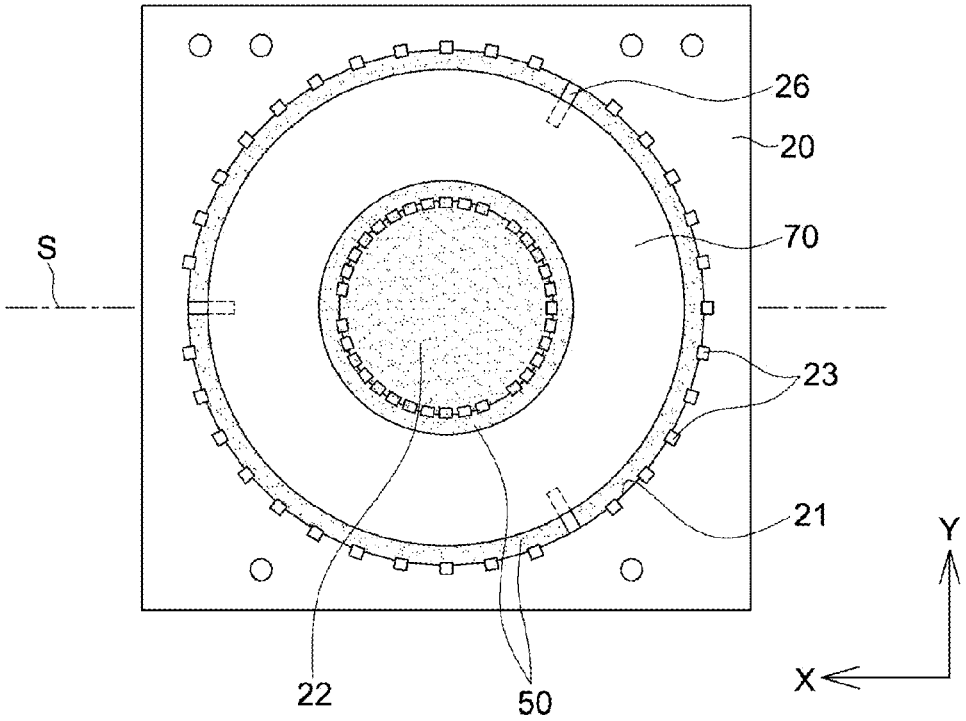
FIG. 3A is a cross-sectional view taken along line A-A of FIG. 1.
Figure 3B:
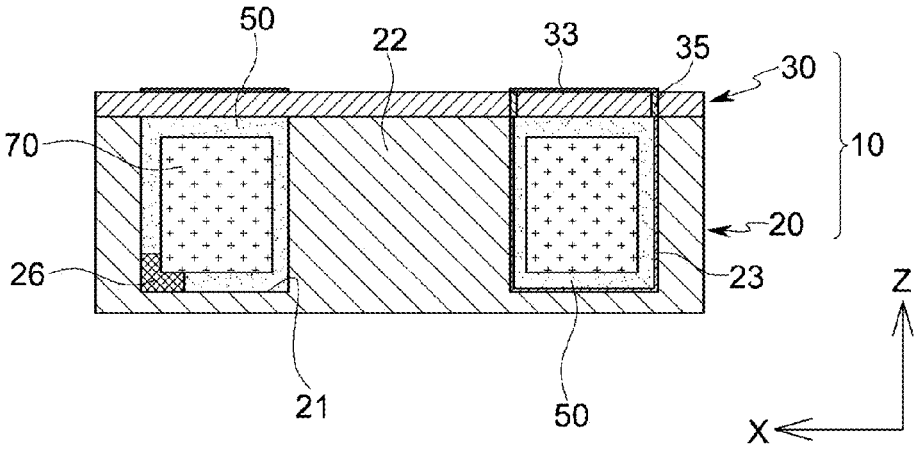
FIG. 3B is a cross-sectional view taken along line B-B of FIG. 1.

FIG. 1 is a perspective view schematically illustrating a coil component according to an exemplary embodiment of the present disclosure, and FIG. 2 is an exploded perspective view illustrating the coil component illustrated in FIG. 1. FIG. 3A is a cross-sectional view taken along line A-A of FIG. 1, and FIG. 3B is a cross-sectional view taken along line B-B of FIG. 1. Here, FIG. 3B illustrates a cross-section taken along line S of FIG. 3A.

Referring to FIGS. 1 through 3B, a coil component according to the exemplary embodiment of the present disclosure may include a board assembly 10 and a core 70 embedded therein.

The board assembly 10 according to the present exemplary embodiment may include a base board 20 and a laminated board 30.

As illustrated in FIG. 2, the base board 20 may have a flat plate shape and may include an accommodation portion 21 in the form of a recess.

The accommodation portion 21 may be annular, and a core 70 as described hereinafter may be inserted thereinto. Thus, the base board 20 may have a columnar support portion 22 formed at the center of the accommodation portion 21.

The accommodation portion 21 according to the present exemplary embodiment may be formed as a recess in the base board 20, and when the laminated board 30 as described hereinafter is laminated on the base board 20, the accommodation portion 21 may be formed as a hermetically closed space.

Conductive patterns 23 may be formed on wall surfaces, namely, on both lateral surfaces, and a bottom surface of the accommodation portion 21. The conductive pattern 23 may be a plurality of linear patterns extending along an inner surface, a bottom surface, and an outer surface of the accommodation portion 21.

The conductive patterns 23 may be a conductive thin film, a conductive via, or the like, and a plurality of conductive patterns 23 may extend radially from the center of the support portion 22 along the lateral surface and the bottom surface of the accommodation portion 21. The conductive patterns 23 according to the present exemplary embodiment may be exposed outwardly from the wall surface and the bottom surface of the accommodation portion 21. However, the present disclosure is not limited thereto and a portion or the entirety of the conductive patterns 23 may be embedded in the base board 20 as needed. Also, in order to protect the conductive patterns 23, an insulating layer may be formed on an outer surface of the exposed conductive patterns 23. Namely, the conductive patterns 23 may be variously modified.

The conductive patterns 23 may be formed by depositing a conductive member such as copper (Cu) within the accommodation portion 21, and if necessary, a plated layer may be formed on a surface of the conductive patterns through electroless plating, or the like. Also, conductive patterns 23 may be formed by forming a conductive via and subsequently cutting the conductive via.

An end of each conductive pattern 23 may be exposed to an upper surface of the base board 20. Namely, both ends of the conductive patterns 23 may be exposed to an outer upper surface of the accommodation portion 21 and an upper surface of the support portion 22.

The conductive patterns 23 are provided to serve as a coil of the coil component 100 according to the present exemplary embodiment. Thus, the plurality of conductive patterns 23 are spaced apart from one another at predetermined intervals.

Also, the base board 20 according to the present exemplary embodiment may include at least on core guide 26 formed within the accommodation portion 21.

The core guide 26 may define an insertion position of the core 70 when the core 70 is accommodated within the accommodation portion 21 of the base board 20, and restrict movement of the core 70 within the accommodation portion 21. Also, the core guide 26 separates the core 70 disposed within the accommodation portion 21 from an inner surface of the accommodation portion 21 and maintains the core 70.

If the core 70 is lopsidedly accommodated within the accommodation portion 21, rather than being fixed to an accurate position within the accommodation portion 21, the core 70 may be disposed very close to a particular conductive pattern 23, while being separated from a conductive pattern on the opposite side thereof to be relatively distant. In this case, an interval between the insulating between the core 70 and the conductive patterns 23 (i.e., coil) cannot be uniformly maintained, failing to secure insulation between the core 70 and the conductive patterns 23. Also, efficiency of the coil component 100 may be degraded.

Thus, the coil component 100 according to the present exemplary embodiment has the core guide 26 formed in a bottom corner portion of the accommodation portion 21.

The core guide 26 may be formed along the entirety of the corner, and a plurality of core guides may be formed as protrusions and spaced apart from one another.

The core guide 26 is provided to restrict movement of the core 70 with respect to X, Y, and Z directions of FIG. 2, and the coil component 100 according to the present exemplary embodiment has three core guides 26.

The core guides 26 may have an L shape, and may be disposed on the corner portion where the bottom surface and outer side wall of the accommodation portion 21 meet.

A plurality of core guides 26 may be spaced apart from one another at equal intervals such that the entire outer surface of the core 70 is maintained at the same distance from the side walls of the accommodation portion 21. In the present exemplary embodiment, three code guides 26 are disposed at intervals with angles of 120° therebetween within the accommodation portion 21. However, the present disclosure is not limited thereto and the core guides may be disposed in various forms as long as the core 70 may be stably fixed.

Movement of the core 70 in the X and Y directions may be completely prevented due to the core guide 26. Also, downward movement of the core 70 in the Z axis direction may be completely prevented. Thus, a position of the core within the accommodation portion 21 may be definitely limited, and thus, the core 70 may be definitely separated from the conductive patterns 23 formed within the accommodation portion 21. Also, since the distance between the core 70 and the coil (conductive patterns) is maintained, insulation therebetween may be secured.

The base board 20 configured as described above may be formed of an insulating resin, and may be formed of a material having a high heat resistance and a high voltage resistance. For example, polyphenylene sulfide (PPS), liquid polyester (LCP), polybutyleneterephthalate (PBT), or FR-4 obtained by laminating glass fiber impregnated with epoxy resin, and the like, may be used as a material used to form the base board 20.

Also, the base board 20 may be formed through various methods as needed such as a method of laminating a plurality of boards, a method of injection-molding the base board 20 by using a mold, and the like.

The laminated board 30 may be laminated on an upper surface of the base board 20. Namely, the laminated board may serve as a cover hermetically sealing the accommodation portion 21 by blocking an entrance of the accommodation portion 21 of the base board. Thus, the core 70 may be completely embedded in the board assembly 10 by the laminated board 30.

Various types of boards (for example, a ceramic board, a printed circuit board, a flexible board, and the like) well known in the art may be used as the laminated board 30. The laminated board 30 may be formed as a single layer or a multilayer board.

Conductive patterns 33 corresponding to the conductive patterns 23 of the base board 20 are disposed on one surface of the laminated board 30. The conductive patterns 33 of the laminated board 30 may be electrically connected to the conductive patterns 23 exposed from the upper surface of the base board 20 to form a shape of the coil. Here, the coil may be formed to have a solenoid shape and may be wound around the core 70.

Thus, like the conductive patterns 23 of the base board 20, a plurality of conductive patterns 33 of the laminated board 30 may be formed radially from the center of the laminated board 30 and may be disposed to be spaced apart from one another at a predetermined pitch.

Meanwhile, in the laminated board 30 according to the present exemplary embodiment, the conductive patterns are formed in an upper surface thereof and may be electrically connected to the conductive patterns 23 of the base board 20 through vias 35 formed in both ends of the conductive patterns 23. However, a configuration of the present disclosure is not limited thereto and may be variously applied. For example, conductive patterns may be formed on a lower surface of the laminated board 30 and both ends of the conductive patterns may be directly bonded to the conductive patterns 23 of the base board 20.

Also, the conductive patterns 23 and 33 implement a shape of a coil eventually enclosing the core 70, and to this end, the conductive patterns 33 of the laminated board 30 according to the present exemplary embodiment may have an oblique line shape moving 1 pitch each time outwards. Thus, when the conductive patterns of the laminated board 30 and the conductive patterns 23 of the base board 20 are electrically connected, a coil shape may be completely formed.

However, the configuration of the present disclosure is not limited thereto and may be variously applied as needed. For example, the conductive patterns 23 of the base board 20 may have an oblique line shape to form a coil, Also, a plurality of external terminals (not shown) may be formed on one surface, namely, on an outer surface, of the laminated board 30 according to the present exemplary embodiment.

The external terminals may be electrically connected to the conductive patterns 23 and 33, and in this case, the external terminals may be electrically and physically connected to a main board (not shown) by solder, or the like, when the coil component 100 is mounted on the main board.

As illustrated in FIG. 2, the core 70 may be formed as an annular magnetic core or an annular toroidal core. As mentioned above, the core 70 is disposed in the accommodation portion 21 of the board assembly 10.

The core 70 may be formed of Mn—Zn-based ferrite having high magnetic permeability, making low loss, having high saturation magnetic flux density, having stability, and incurring low manufacturing costs, relative to other materials. However, the present disclosure is not limited thereto and the core 70 may be formed of various materials as long as they have high degrees of magnetic permeability such as an amorphous magnetic plate or foil, amorphous magnetic wire, a permalloy plate, and the like.

Also, although not shown, a coating layer formed of an insulating material may be formed on an outer surface of the core 70 in order to insulate the core 70 from the conductive patterns 23 and 33.

A mold part 50 is formed of an insulting material and fills the interior of accommodation portion 21. Namely, the mold part 50 fills a space between the core 70 and the base board 20 within the accommodation portion 21, and fixes the core 70 within the accommodation portion 21.

The mold part 50 may be formed of an insulating material including a resin material such as an epoxy, or the like. Also, the mold part 50 according to the present exemplary embodiment may be formed by injecting a liquid insulating material into the accommodation portion 21 and curing the same.

As the mold part 50 is formed, movement of the core 70 in the Z direction is restricted. Thus, the movement of the core 70 in the X, Y, and Z directions according to the present exemplary embodiment is completely prevented by the core guide 26 and the mold part 50.

Meanwhile, in the present exemplary embodiment, the movement of the core 70 in the Z direction is prevented, but the present disclosure may be variously modified.

For example, the mold part 50 may be omitted and an annular packing may be inserted between the core 70 and the laminated board 30. In this case, the packing may have a thickness corresponding to a thickness of the space between the core 70 and the laminated board 30. The packing may be formed of a material having elasticity such as rubber. Also, the packing may be disposed to be in surface contact with an upper surface of the core 70 and a lower surface of the laminated board 330 and may have a shape corresponding to the upper surface of the core 70.

In another example, the mold part 50 may be omitted and a protrusion may be formed on the lower surface of the laminated board 30 and used instead of the packing. In this case, the protrusion may have a shape of the above packing or may have a shape of a plurality of projections.

In the coil component 100 according to the present exemplary embodiment configured as described above, the core 70 is embedded in the board assembly 10. Also, a coil is implemented by the conductive patterns 23 and 33 formed on the base board 20 and the laminated board 30.

Thus, since the coil component 100 is manufactured through only the process of preparing the base board 20, the laminated board 30, and the core 70 and coupling them, it is convenient to manufacture the coil.

Also, in the coil component 100 according to the present exemplary embodiment, since the core 70 is embedded within the board assembly 10, a bobbin, which is used in the related art, is not employed. Thus, an overall volume of the coil component 100 may be reduced, and thus, a coil component 100 is easy to be loaded in a subminiature electronic device.

Meanwhile, the coil component 100 according to the present exemplary embodiment may not be limited to the aforementioned exemplary embodiment and may be variously modified.

Figure 4A:
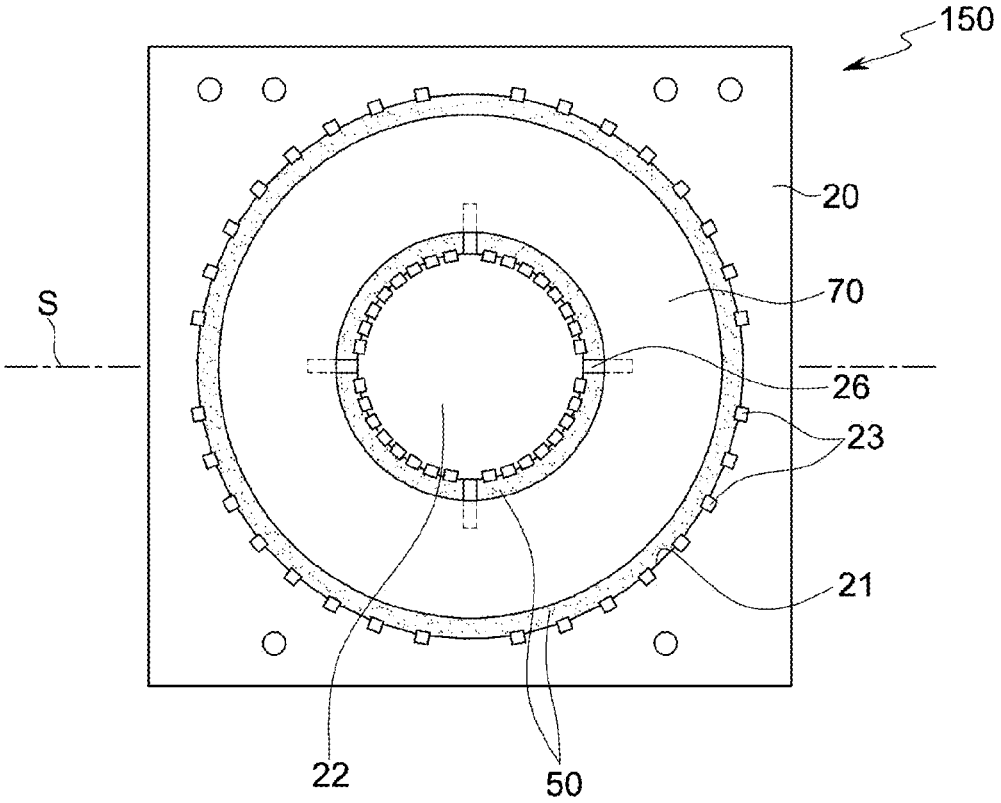
FIGS. 4A and 4B are cross-sectional views schematically illustrating a coil component according to another exemplary embodiment of the present disclosure.
Figure 4B:
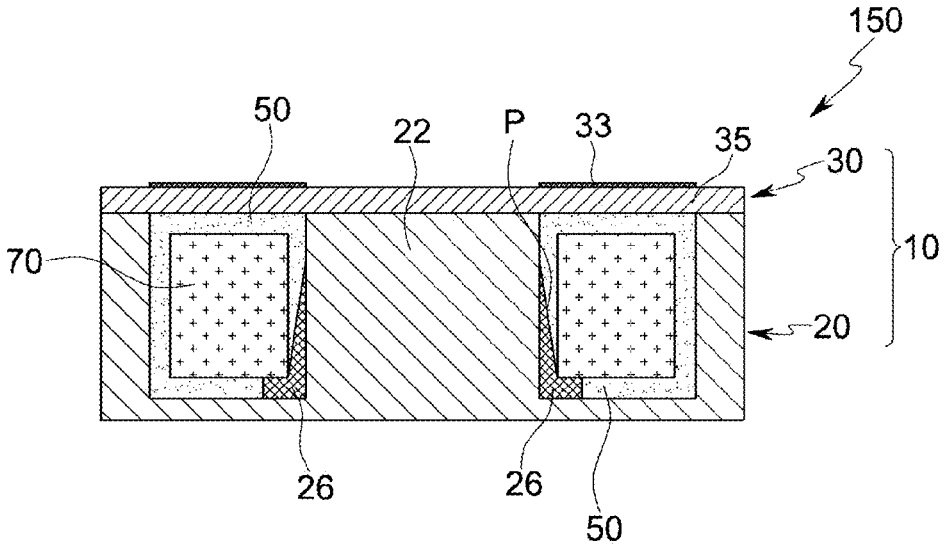

FIGS. 4A and 4B are cross-sectional views schematically illustrating a coil component according to another exemplary embodiment of the present disclosure, which illustrate cross-sections corresponding to FIGS. 3A and 3B, respectively. Also, FIG. 4B illustrates a cross-section taken along line S of FIG. 4A.

Referring to FIGS. 4A and 4B, in a coil component 150 according to the present exemplary embodiment, a core guide 26 is formed along the corner where a bottom surface of the accommodation portion 21 and an inner side wall, namely, a side wall of the support portion 22 meet.

In the present exemplary embodiment, four core guides 26 are provided. Thus, the core guides 26 may be disposed at equal intervals of 90° around the supporting portion 22 within the accommodation portion 21.

Also, in the present exemplary embodiment, a width of each core guide 26 protruding from the side wall of the support portion 22 may be reduced towards an upper end thereof. Namely, a portion of each core guide 26 facing an inner circumferential surface of the core 70 has an inclined surface P.

In this case, when the core 70 is inserted into the accommodation portion 21, the core 70 may be guided into the accommodation portion 21 along the inclined surface P of each core guide 26, and thus, insertion of the core 70 may be facilitated.

Meanwhile, in the present exemplary embodiment, the case in which all of the four core guides 26 are formed along the corners where the bottom surface of the accommodation portion 21 and the side wall of the support portion 22 meet is illustrated as an example. However, a configuration of the present disclosure is not limited thereto.

Figure 5:
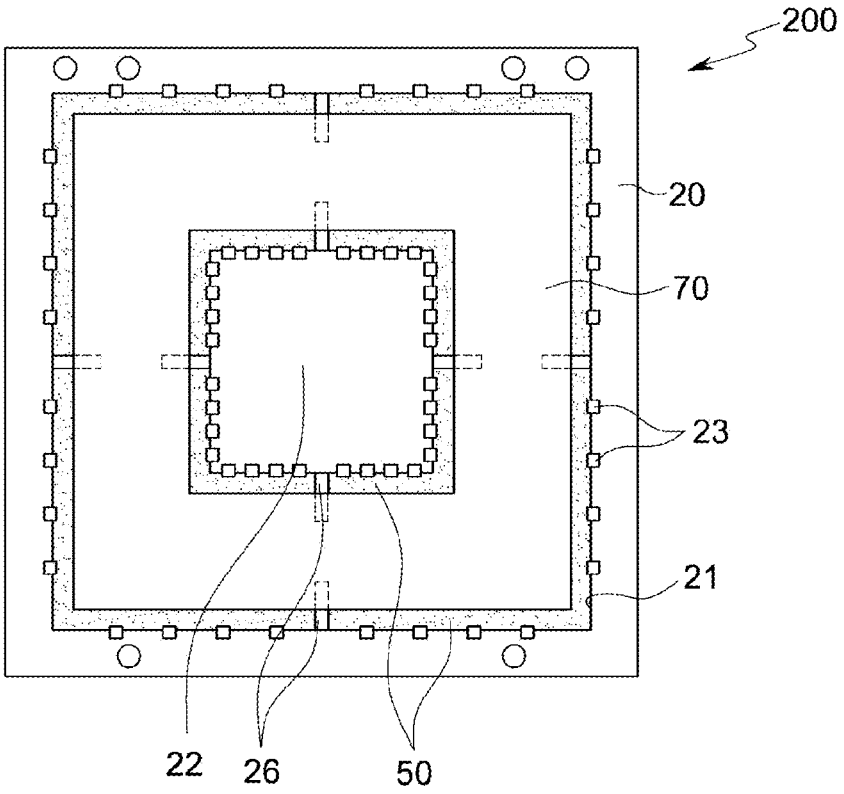
FIG. 5 is a cross-sectional view schematically illustrating a coil component according to another exemplary embodiment of the present disclosure.

FIG. 5 is a cross-sectional view schematically illustrating a coil component 200 according to another exemplary embodiment of the present disclosure, which illustrates a cross-sectional corresponding to FIG. 3A.

Referring to FIG. 5, core guides 26 are formed in both of a corner where a bottom surface of an accommodation portion 21 and an outer side wall meet and a corner where the bottom surface of the accommodation portion 21 and an inner side wall meet.

In the present exemplary embodiment, a case in which the core guides 26 formed in the inner corner and the outer corner are disposed to face one another is illustrated as an example. However, the present disclosure is not limited thereto and may be variously applied as needed. For example, the core guides 26 may be disposed in a crisscross manner or may be disposed to be asymmetrical with regard to each other.

Meanwhile, in the coil component 200 according to the present exemplary embodiment, a core 70 has a square shape. In this manner, the shape of the coil component 200 according to the present exemplary embodiment is not limited as long as the core 70 is accommodated within a base board 30, and cores 70 having various shapes such as EE, EI, UU, and UI shapes may be used.

Also, in the aforementioned exemplary embodiment and the present exemplary embodiment, the core has a quadrangular vertical cross-section, but a configuration of the present disclosure is not limited thereto and the core 70 may have various other cross-sections as needed. For example, the core 70 may have a circular, oval, trapezoidal, or a diamond shape.

Figure 6A:
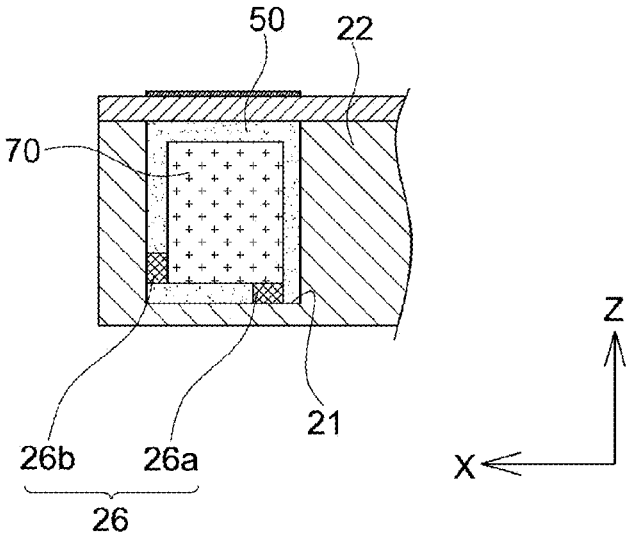
FIGS. 6A and 6B are cross-sectional views schematically illustrating a core guide according to another exemplary embodiment of the present disclosure.
Figure 6B:
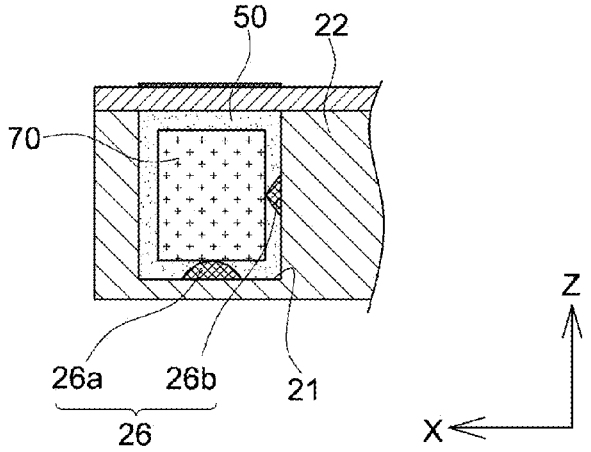

FIGS. 6A and 6B are cross-sectional views schematically illustrating a core guide according to another exemplary embodiment of the present disclosure, which illustrate a cross-sectional corresponding to FIG. 3B.

Referring to FIGS. 6A and 6B, a core guides may include core guides 26*a* and 26*b* individually formed on a bottom surface of the accommodation portion 21 and a side wall, respectively.

As illustrated, the core guide 26*a* formed on the bottom surface and the core guide 26*b* formed on the side wall may have various shapes and a plurality of such core guides may be formed to be protruded as long as they may separate the core 70 from the bottom surface of the side wall of the accommodation portion 21.

Meanwhile, in the present exemplary embodiment, both the core guide 26*a* formed on the bottom surface and the core guide 26*b* formed on the side wall are formed within a single vertical plane, but the present disclosure is not limited thereto and variously applied as needed. For example, the core guide 26*a* and the core guide 26*b* may be disposed in different vertical planes or asymmetrically disposed.

Figure 7:
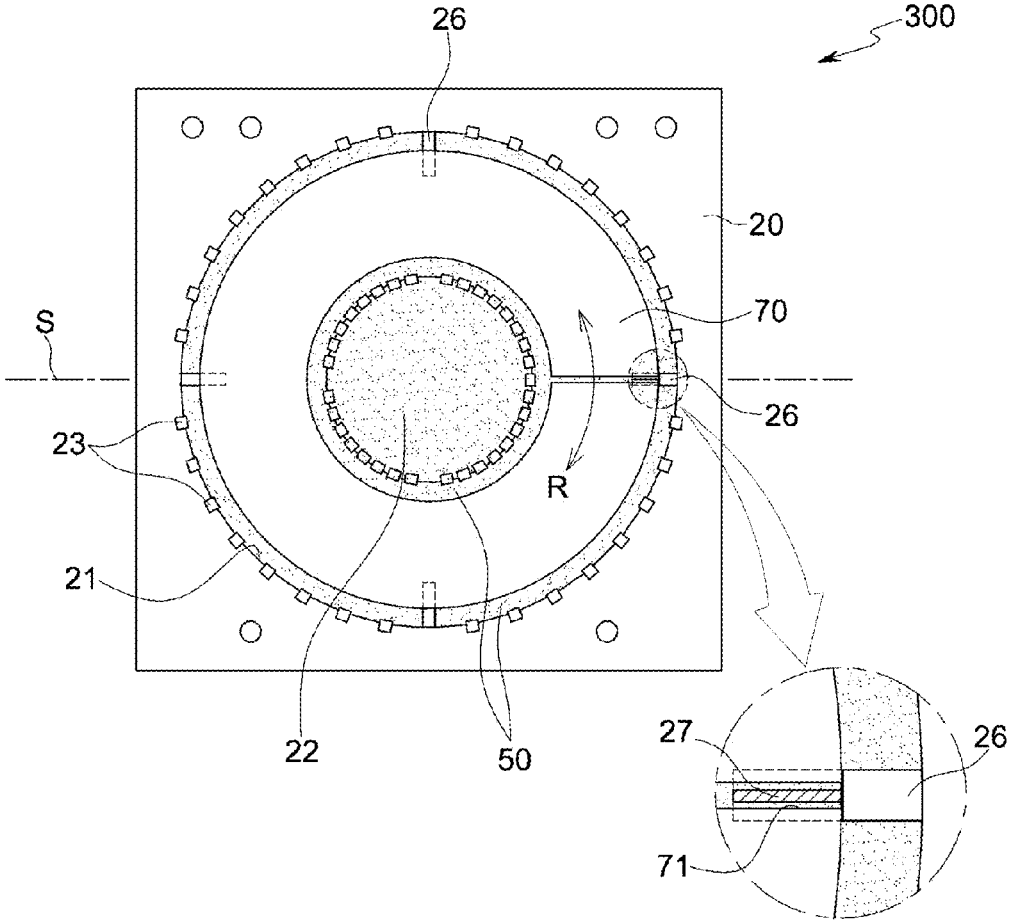
FIGS. 7 and 8 are cross-sectional views schematically illustrating a coil component according to another exemplary embodiment of the present disclosure.
Figure 8:
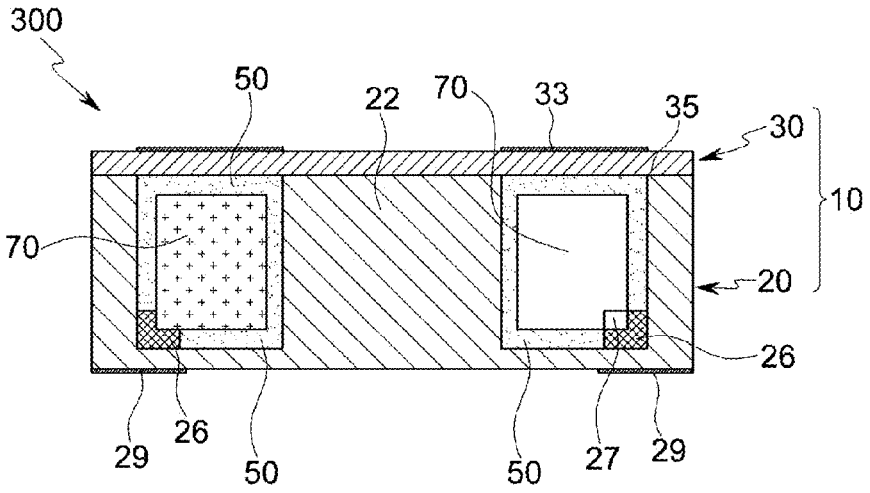

FIGS. 7 and 8 are cross-sectional views schematically illustrating a coil component according to another exemplary embodiment of the present disclosure, which also illustrate cross-sections corresponding to FIGS. 3A and 3B, and FIG. 8 illustrates a cross-section taken along line S of FIG. 7.

Referring to FIGS. 7 and 8, a coil component 300 according to the present disclosure is similar to those of the aforementioned exemplary embodiments as described above and is different in shape of a core 70. In detail, the core 70 has a gap (or an opening) 71 formed by cutting away a portion of an annular shape thereof.

The gap 71 of the core 70 may control inductance of the coil component 300.

In the case of using the core 70 having the gap 71, as the core 70 is shaken within the accommodation portion 21 or rotated in an R direction, the gap 71 may be disposed in a different position, rather than in a particular position. In this case, efficiency of the coil component 300 may be degraded, so, in the coil component 300 according to the present exemplary embodiment, the gap 71 of the core 70 may need to be fixed to the particular position to limit rotation of the core 70 in the R direction.

To this end, the coil component 300 may include at least one insertion protrusion 27.

The insertion protrusion 27 may protrude from the bottom surface or the lateral surface of the accommodation portion 21. Also, the insertion protrusion 27 may be formed in a position separate from that of the core guide 26, or as in the present exemplary embodiment, the insertion protrusion 27 may protrude from any one of a plurality of core guides 26.

The insertion protrusion 27 according to the present exemplary embodiment protrudes from a single core guide 26 toward the core 70 and is inserted into the gap 71 of the core 70. Thus, the insertion protrusion 27 may have a thickness less than the distance of the gap 71 of the core 70.

Also, a protruded length of the insertion protrusion 27 is not limited, and the insertion protrusion 27 may have various sizes and shapes as long as they may limit rotation of the core 70.

Since the movement (rotation) of the core 70 within the accommodation portion 21 is completely prevented by the insertion protrusion 27, the gap 71 of the core 70 may be fixed in the same position (namely, the foregoing particular position) all the time within the accommodation portion 21.

Figure 9:
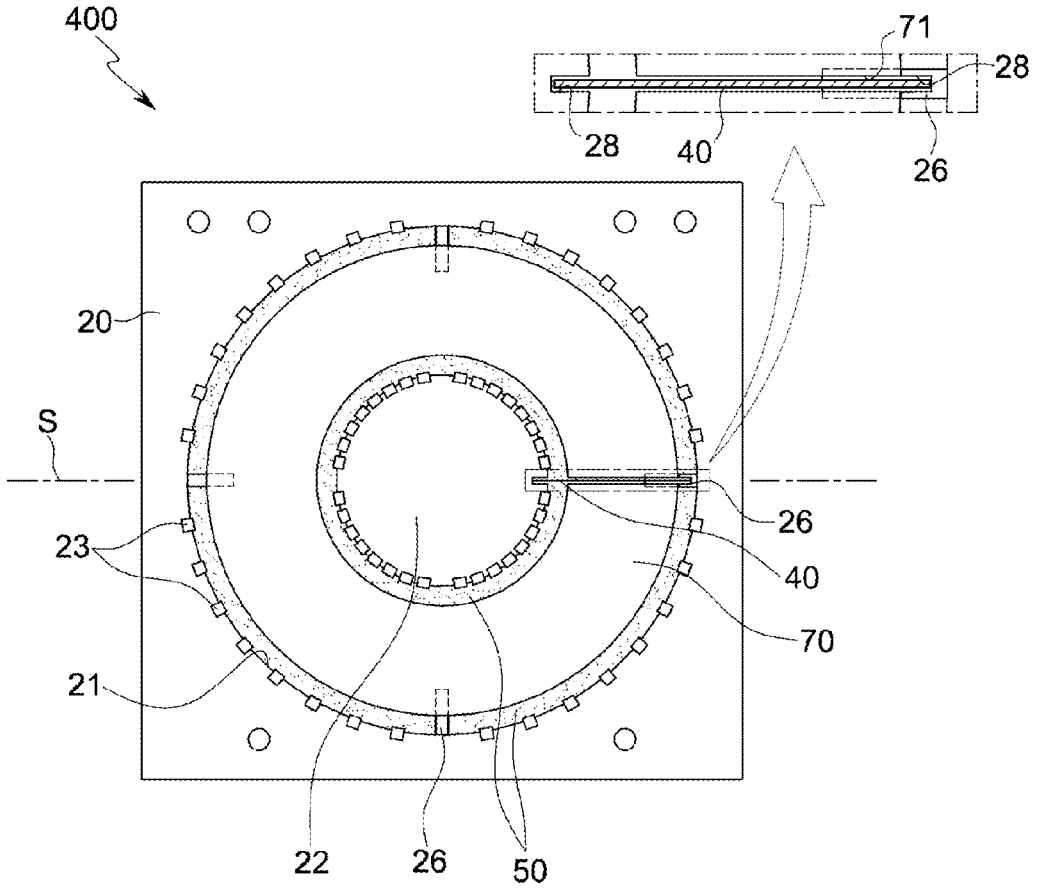
FIGS. 9 and 10 are cross-sectional views schematically illustrating a coil component according to another exemplary embodiment of the present disclosure.
Figure 10:
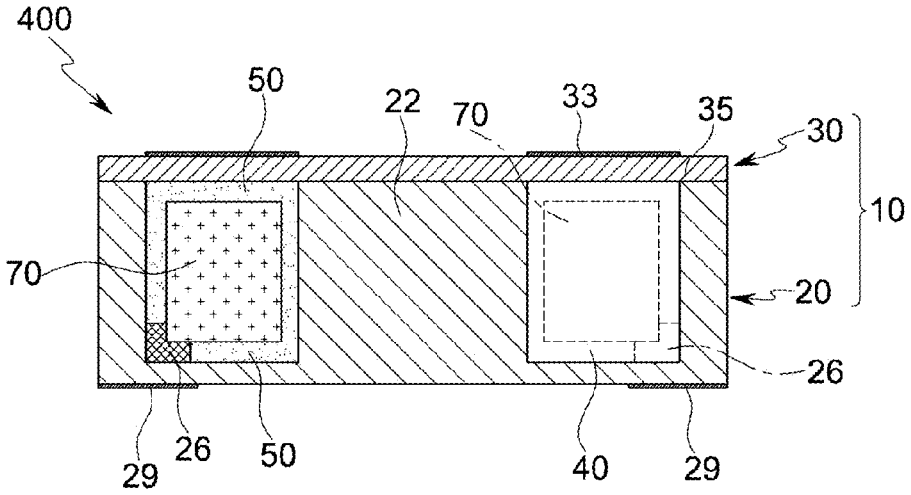

FIGS. 9 and 10 are cross-sectional views schematically illustrating a coil component according to another exemplary embodiment of the present disclosure, which illustrate cross-sections corresponding to FIGS. 3A and 3B, respectively, and FIG. 10 illustrates a cross-sectional view taken along line S of FIG. 9.

Referring to FIGS. 9 and 10, a coil component 400 according to the present exemplary embodiment is similar to that of the aforementioned exemplary embodiment of FIG. 7 and is different in that it includes a barrier 40.

In the coil component 400 according to the present exemplary embodiment, the barrier 40 is inserted into a gap 71 of a core 70.

Like the insertion protrusion 27 of the aforementioned exemplary embodiment as described above, the barrier 40 prevents the rotation of the core within the accommodation portion 21. The barrier 40 is inserted into the gap 71 within the accommodation portion 21 and a portion of the barrier 40 protrudes outwards and is coupled to the base board 20.

To this end, at least one insertion recess 28 may be formed within the accommodation portion 21 of the base board 20 according to the present exemplary embodiment.

The insertion recess 28 may be a recess in which the forgoing barrier 4 is inserted. In the present exemplary embodiment, two insertion recesses may be formed to face one another in the outer and inner side walls of the accommodation portion 21. However, the present disclosure is not limited thereto and variously applied. For example, the insertion recess 28 may be formed on only one of the inner and outer side walls, or may be formed on the bottom surface of the accommodation portion 21, rather than on the side walls.

A thin plate formed of an insulating material may be used as the barrier 40. However, a configuration of the present disclosure is not limited thereto and may be variously applied.

Namely, the barrier 40 may be formed as a mesh type, or a structure in the form of a pin or a frame may be inserted into the gap 71 of the core 70.

Figure 11:
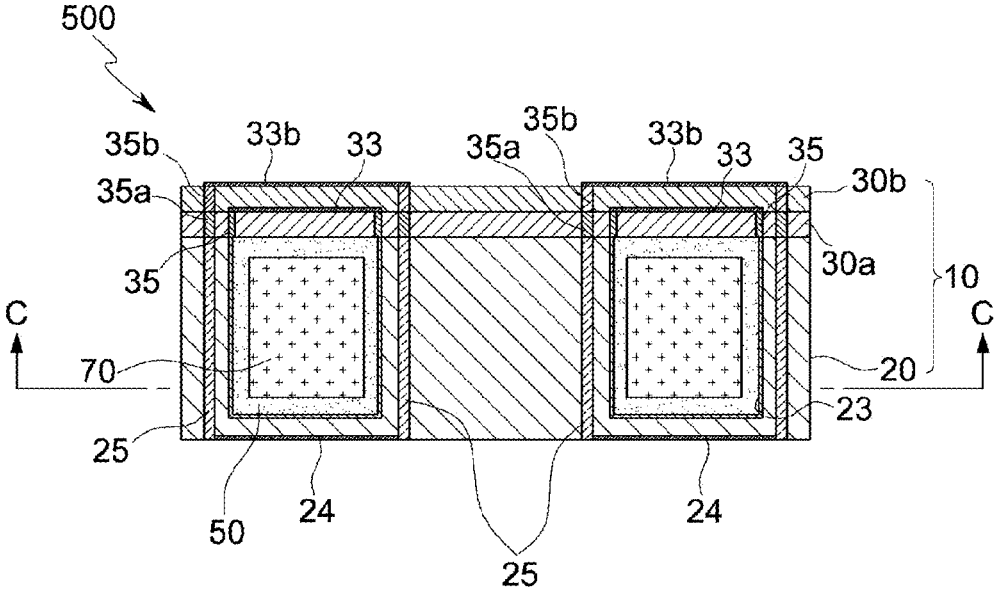
FIG. 11 is a cross-sectional view schematically illustrating a coil component according to another exemplary embodiment of the present disclosure.
Figure 12:
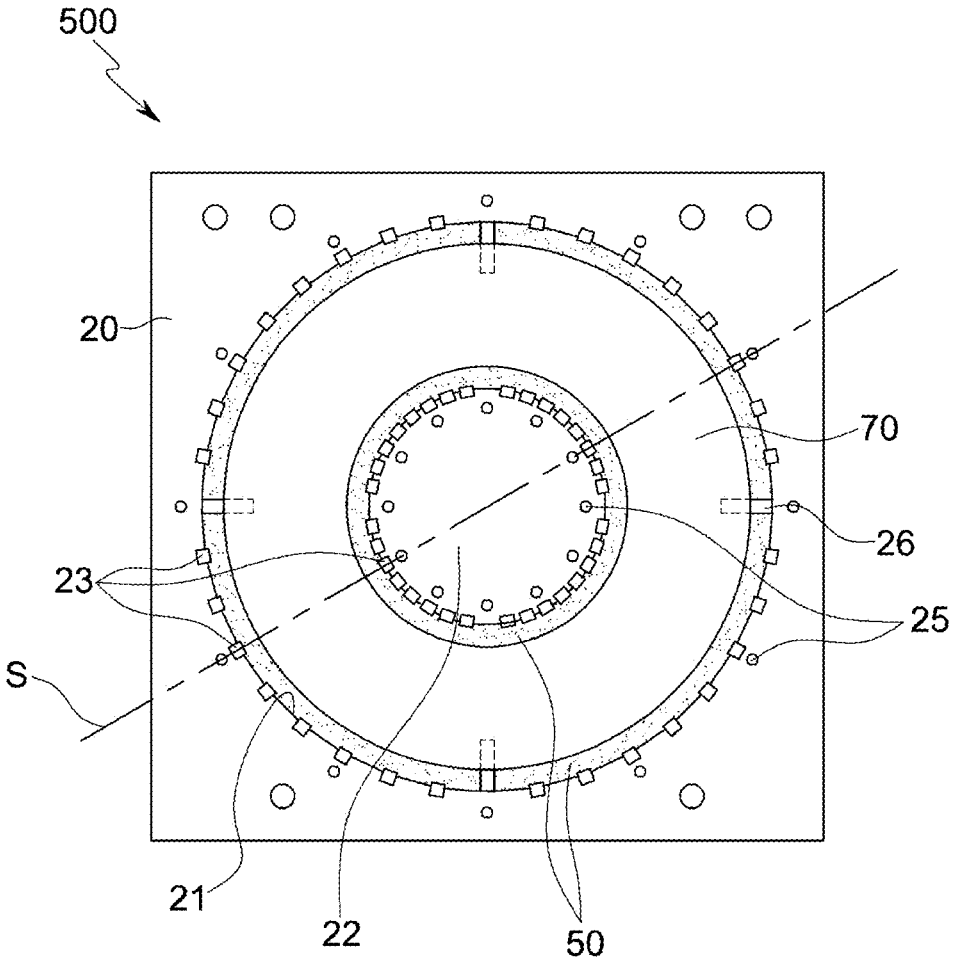
FIG. 12 is a cross-sectional view taken along line C-C of FIG. 11.

FIG. 11 is a cross-sectional view schematically illustrating a coil component according to another exemplary embodiment of the present disclosure, and FIG. 12 is a cross-sectional view taken along line C-C of FIG. 11. Here, FIG. 11 illustrates a cross-section taken along line S of FIG. 12.

Referring to FIGS. 11 and 12, a coil component according to the present exemplary embodiment may include a board assembly 10 and a core 70. Also, the board assembly 10 may include a base board 20, a first board 30*a*, and a second board 30*b*.

The base board 20 is similar to that of the aforementioned exemplary embodiment of FIG. 1, but different from that of the embodiment of FIG. 1 in that a plurality of through vias 25 are formed along the circumference of an accommodation portion 21.

Here, the through vias 25 may be symmetrical on the outer side of the accommodation portion 21 and on the inner side of the support portion 22.

Also, conductive patterns 24 may be formed on a lower surface of the base board 20, and the through vias 25 may be electrically connected to both ends of the conductive patterns 24.

The first board 30*a* is similar to the foregoing laminated board 30 of FIG. 2, and different in that it further includes through vias 35*a* to form a second coil.

Namely, the through vias 35 and 35*a* formed in the first board 30*a* may be classified as the vias 35*a* for a second coil electrically connected to the through vias 25 formed on the base board 20 and the vias 35 for a first coil connected to the conductive patterns 23 formed on the base board 20.

The second board 30*b* is laminated on an upper surface of the first board 30*a*. Conductive patterns 33*b* may be formed on an upper surface of the second board 30*b*, and through vias 35*b* may be formed in both ends of the conductive patterns 33*b*. The conductive patterns 33*b* of the second board 30*b* may be electrically connected to the through vias 35*a* of the first board 30*a* through the through vias 35*b*.

In the coil component 500 according to the present exemplary embedment configured as described above, a first coil is formed of the conductive patterns 23 formed within the accommodation portion 21 of the base board 20 and the conductive patterns 33 formed on the first board 30*a* are electrically connected by the vias 35 for a first coil. Also, a second coil is formed by the through vias 25 and 35*a* formed on the base board 20 and the first and second boards 30*a* and 30*b* and the conductive patterns 33*b* and 24 formed on the base board 20 and the second board 30*b*.

Thus, the coil component 500 according to the present exemplary embedment includes the first and second coils which are independent from one another, and thus, the coil component 500 may be easily applied to a transformer, or the like.

Meanwhile, although not shown, like the exemplary embodiments as described above, a core having a gap may be embedded in the coil component 500, and a core guide and an insertion protrusion may also be provided within the accommodation portion.

Also, in the present exemplary embodiment, the case in which the second coil is provided by using the second board is an example, but a configuration of the present disclosure is not limited thereto. For example, conductive patterns of the first coil may be formed on a lower surface of the board and conductive patterns of the second coil may be formed on an upper surface of the first board. In this case, the second board may be omitted.

Also, in the present exemplary embodiment, the case in which the second coil is formed by separately forming the through vias on the base board is illustrated as an example, but a configuration of the present disclosure is not limited thereto. For example, the first and second coils may be configured together with the conductive patterns of the accommodation portion. Namely, a portion of the conductive patterns of the accommodation portion may be used as a first coil and the other portion thereof may be used as a second coil. Also, third and fourth coils may also be configured in the same manner as needed.

Figure 13:
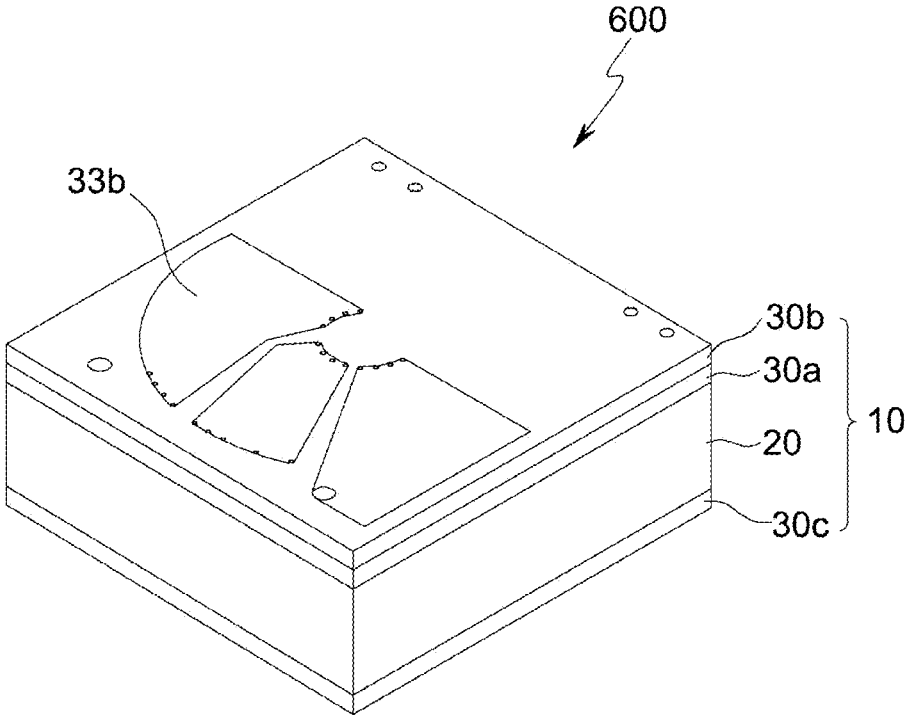
FIG. 13 is a perspective view schematically illustrating a coil component according to another exemplary embodiment of the present disclosure.
Figure 14:
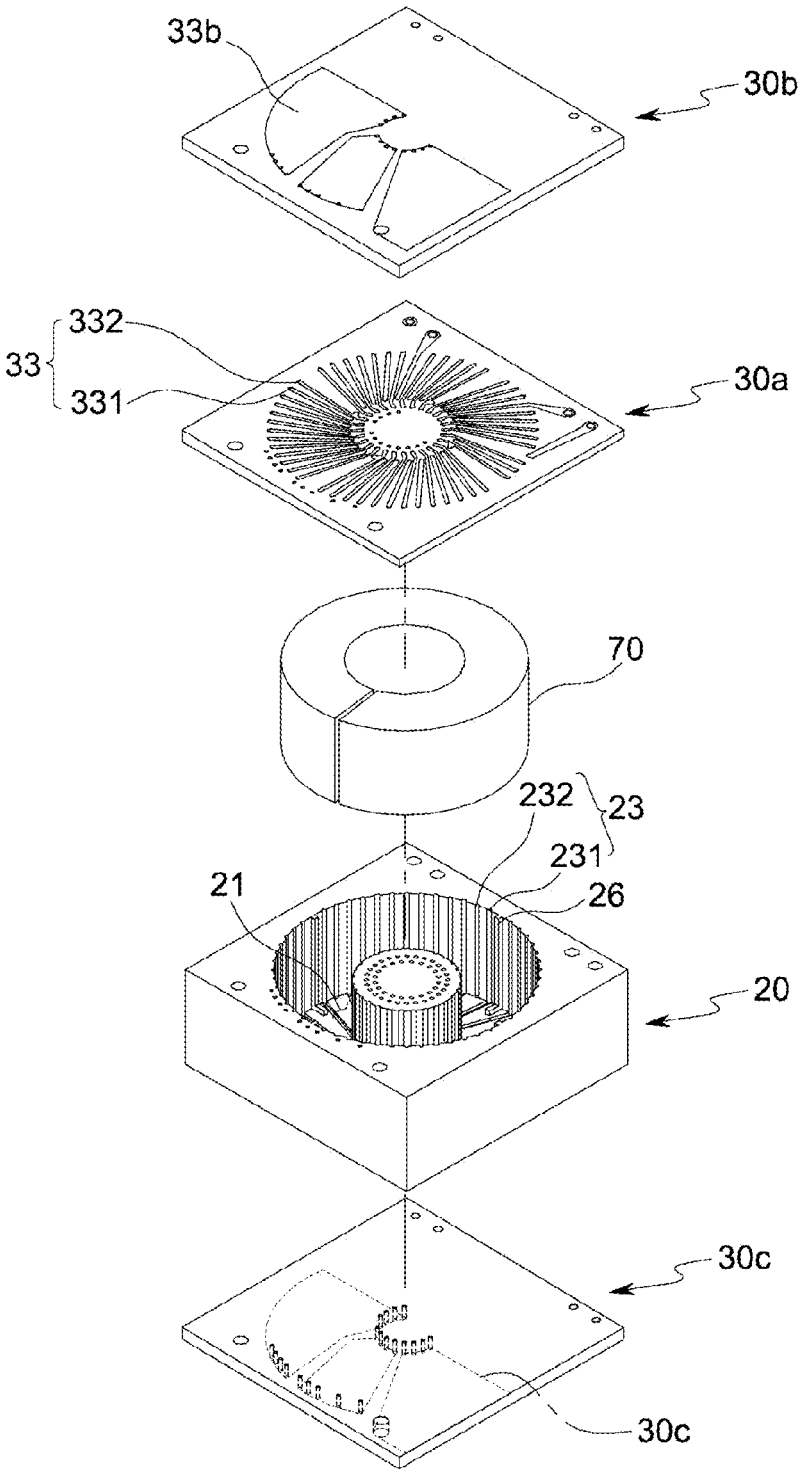
FIG. 14 is an exploded perspective view illustrating the coil component of FIG. 13.
Figure 15:
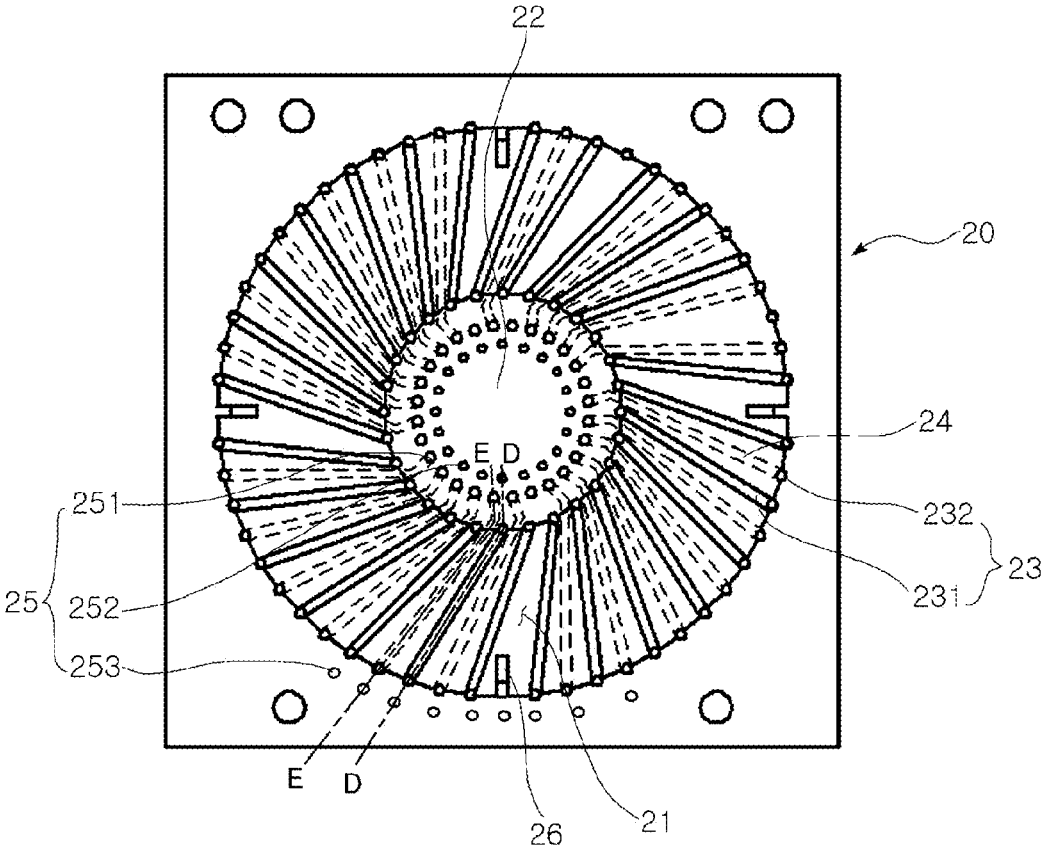
FIG. 15 is a plan view illustrating a base board of FIG. 14.

FIG. 13 is a perspective view schematically illustrating a coil component according to another exemplary embodiment of the present disclosure, FIG. 14 is an exploded perspective view illustrating the coil component of FIG. 13, and FIG. 15 is a plan view illustrating a base board of FIG. 14.

Figure 16:
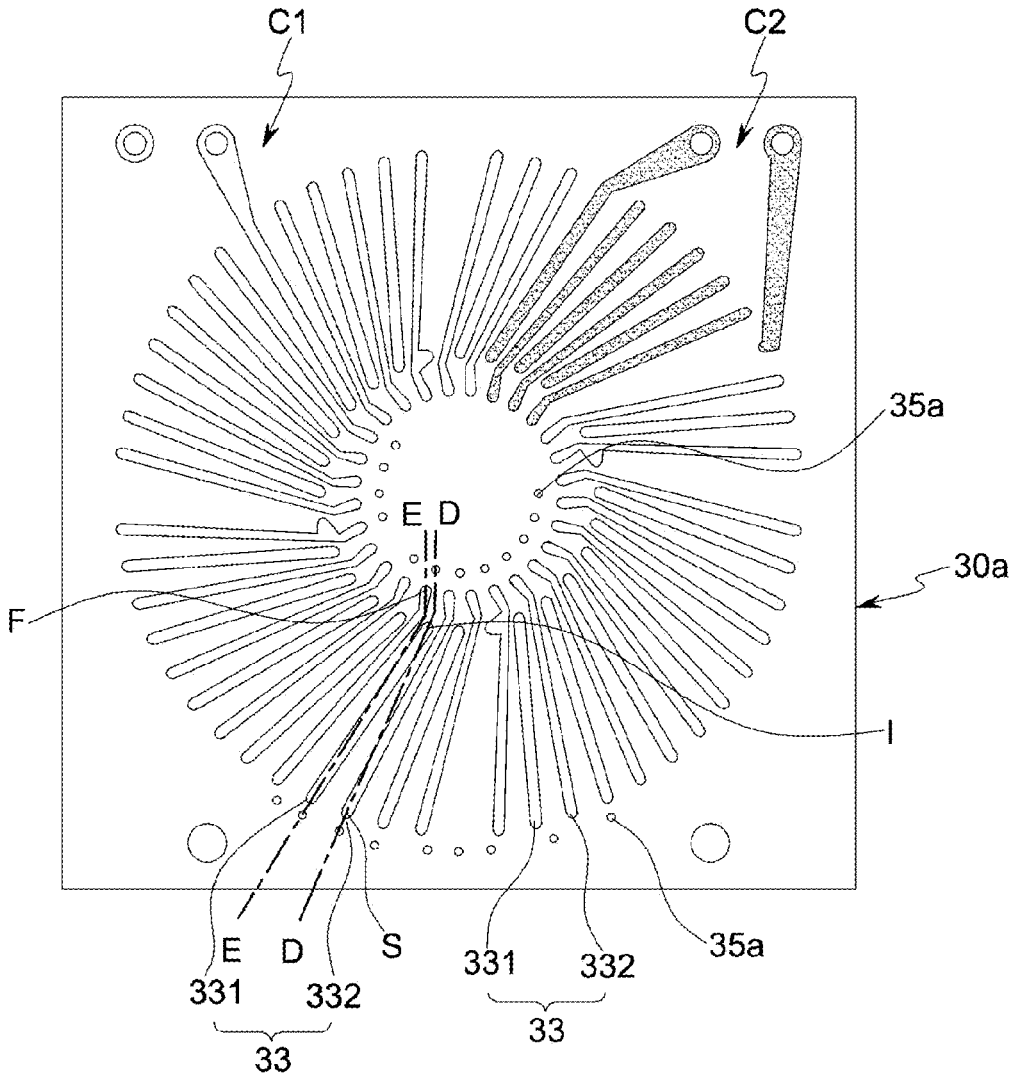
FIG. 16 is a plan view illustrating a first board of FIG. 14.
Figure 17:
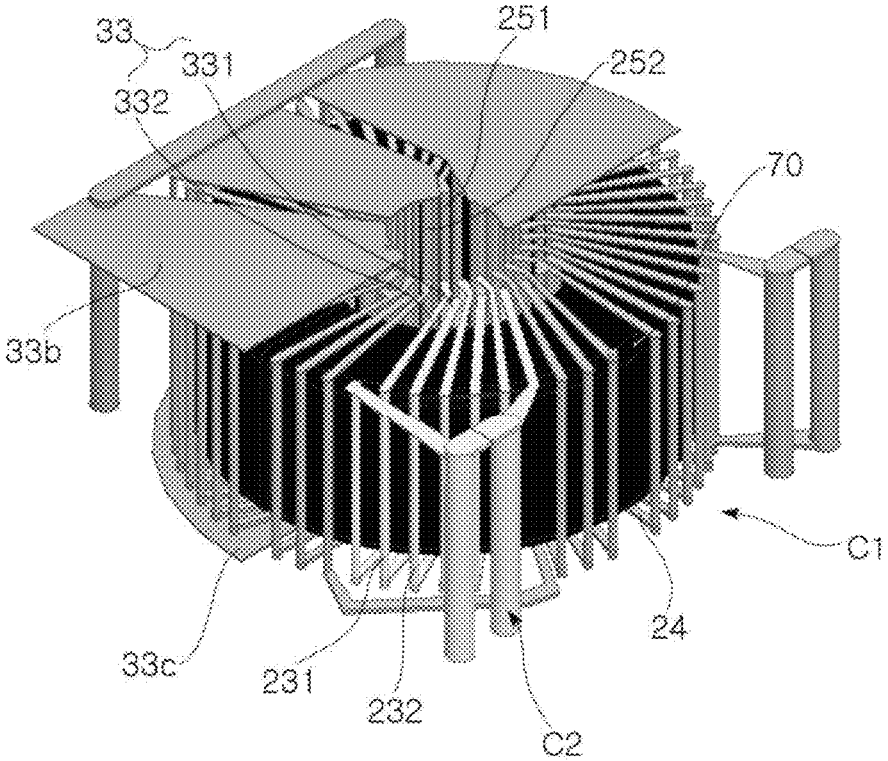
FIG. 17 is a perspective view illustrating only a coil and a core without a board in FIG. 13.
Figure 18A:
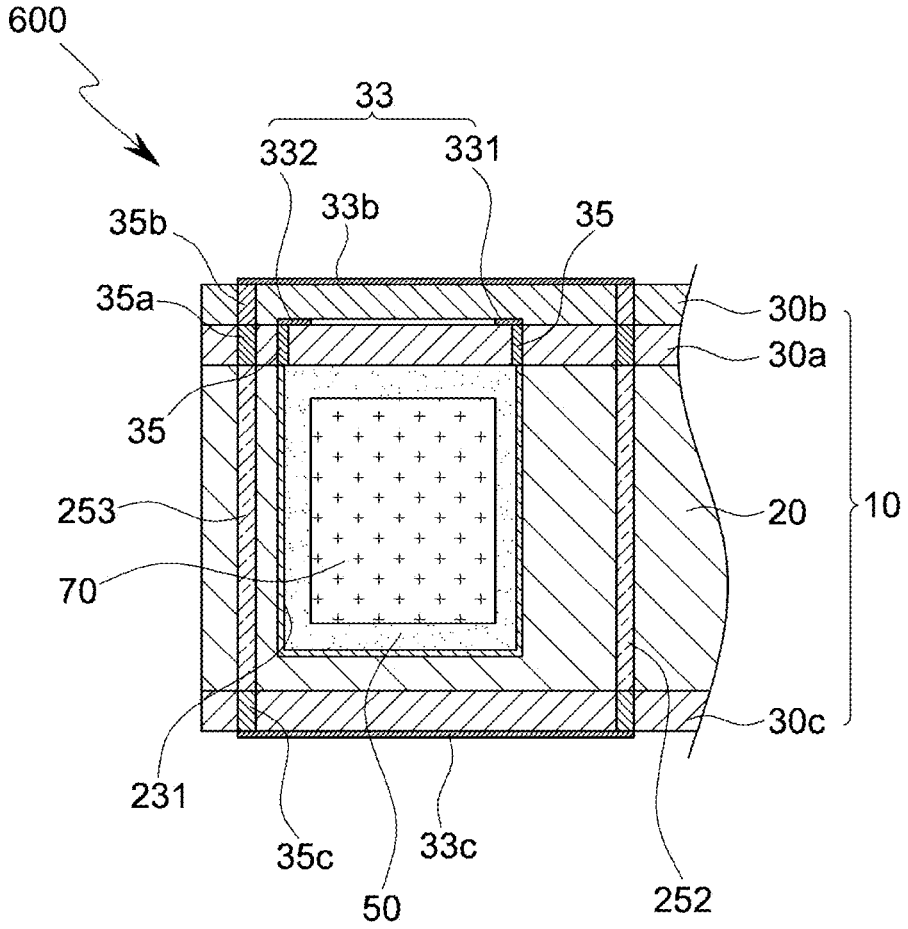
FIGS. 18A and 18B are cross-sectional views of the coil component of FIG. 13.
Figure 18B:
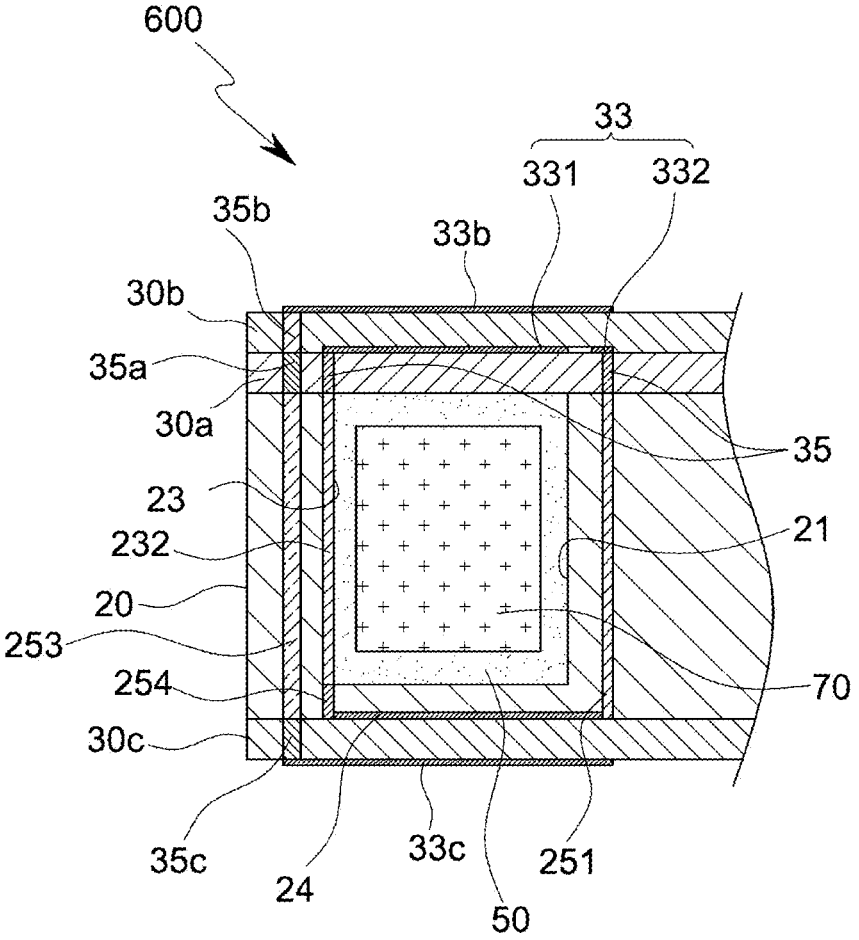

FIG. 16 is a plan view illustrating a first board of FIG. 14, FIG. 17 is a perspective view illustrating only a coil and a core without a board in FIG. 13, and FIGS. 18A and 18B are cross-sectional views of the coil component of FIG. 13.

Here, FIG. 18A illustrates a cross-section taken along line D-D of FIGS. 16 and 17, and FIG. 18B illustrates a cross-section taken along line E-E of FIG. 17.

Referring to FIGS. 13 through 18B, a coil component 600 according to the present exemplary embodiment may include a board assembly 10 and a core 70.

The core 70 may have a gap, like that of the aforementioned exemplary embodiment.

The board assembly 10 may have a core guide 26, like that of the aforementioned exemplary embodiment, and may include a base board 20, a first board 30*a*, a second board 30*b*, and a third board 30*c*.

The base board 20 is configured to be similar to that of the exemplary embodiment as described above with reference to FIG. 1, and different in that a plurality of through vias are formed along the circumference of an accommodation portion 21.

The base board 20 according to the present exemplary embodiment may have conductive patterns 23 formed on a first side wall, namely, an outer wall, of the accommodation portion 21, and here, the number of the conductive patterns 23 may be double the number of conductive patterns formed on an inner wall, namely, a second side wall, of the accommodation portion 21. Thus, only half of the conductive patterns 23 formed on the outer wall of the accommodation portion 21 may be connected to the conductive patterns formed on the inner wall of the accommodation portion 21 through bottom surface. The other half is connected to connection vias (254 in FIG. 18B) as described hereinafter.

Also, as illustrated in FIGS. 14, 18A and 18B, in the present exemplary embodiment, the conductive patterns 23 disposed on the outer wall of the accommodation portion 21 may include conductive patterns 231 (hereinafter, referred to as 'first conductive patterns') and conductive patterns 232 (hereinafter, referred to as 'second conductive patterns'). The first conductive patterns 231 may be disposed to extend to the inner wall of the accommodation portion 21 along the bottom surface, and the second conductive patterns 232 connected to connection vias 254 may be alternately disposed in a radial manner, based on a support portion 22 as a center.

As illustrated in FIG. 15, the through vias 25 may include first through vias 251 formed within the support portion 22, second through vias 252 disposed at the center side of the support portion 22, relative to the first through vias 251, third through vias 253 disposed on the outer circumference of the accommodation portion 21, and connection vias 254 (in FIG. 18 B).

Here, the first through vias 251 may be disposed between the first conductive patterns 231 formed on the side wall of the support portion 22. Also, the first through vias 251 may be formed to correspond to the number of the first conductive patterns 231 formed on the support portion 22.

Thus, the first through vias 251 and the first conductive patterns 231 formed on the support portion 22 may be disposed in a zigzag manner on the outer circumferential surface of the support portion 22.

The second and third through vias 252 and 253 may form a second coil, and may have a structure identical to that of the through vias 25 as described above with reference to FIG. 11.

As illustrated in FIG. 18B, the connection vias 254 may penetrate through the base board 20 in lower ends of the second conductive patterns 232, such that the conductive vias 254 extend from the second conductive patterns 232 on the outer wall of the accommodation portion 21. Thus, the connection vias 254 may penetrate through the bottom surface of the accommodation portion 21, namely, the base board 20.

Also, a lower conductive pattern 24 may be formed on a lower surface of the base board 20. One end of the lower conductive pattern 24 is electrically connected to the first through vias 251 and the other end thereof is electrically connected to the second conductive pattern 232 within the accommodation portion 21 by the medium of the connection via 254.

Namely, the lower conductive pattern 24 connects the second conductive patterns 222 with the accommodation portion 21 and the first through via holes 251.

The first board 30*a* is similar to that of the first board 30*a* as described above with reference to FIG. 11. Namely, the first board 30*a* may include the vias 35 for a first coil and vias 35*a* for a second coil.

Here, as illustrated in FIG. 18B, the vias 35 for a first coil may be formed in positions from which the conductive patterns 23 formed in the side wall of the accommodation portion 21 extend and in positions from which the first through vias 251 of the base board 2 extend.

Also, the vias 35*a* for a second coil may be formed in positions from which the second through vias 252 and the third through vias 253 of the base board 20 extend, respectively.

Also, each of the conductive patterns 33 of the first board 30*a* may include first connection pattern 331 and a second connection pattern 332.

As illustrated in FIGS. 15 through 17, the first connection pattern 331 electrically connects the second conductive patterns 232 of the base board 20 and the first conductive patterns 231 formed on the inner side wall of the accommodation portion 21. Namely, the first connection patterns 331 electrically connect the adjacent second conductive patterns 232 and the first conductive patterns 231 to form one coil turn.

The second connection patterns 332 electrically connect the first conductive patterns 231 formed on the outer side wall of the accommodation portion 21 of the base board 20 and the first through vias 251. Namely, the second connection patterns 332 electrically connect the second conductive patterns 232 and the first through vias 251 disposed therein to form one coil turn.

As illustrated in FIG. 16, the first and second connection patterns 331 and 332 may be disposed in a radial manner from the center of the first board 30*a* and may be alternately disposed. However, the present disclosure is not limited thereto.

Here, the first and second connection patterns 331 and 332 are electrically connected to the first conductive patterns 231, the second conductive patterns 232, and the first through vias 251 by the through vias 35 for a first coil, respectively. However, details thereof will be omitted for the purposes of description.

Meanwhile, the second connection patterns 332 connected to the first through vias 251 have a bending point at an inner side. Namely, the second connection patterns 332 extend inwards, relative to the first connection patterns 331, are bent at a predetermined angle, and subsequently extend so as to be electrically connected to the first through vias 251.

Due to the above configuration, the first coil according to the present exemplary embodiment encloses the core. A specific path of the first coil will be described as follows.

Referring to FIGS. 16 and 18A, a path of the first coil starts from S of FIG. 16. A first coil turn (single winding) is formed with the second connection pattern 332 of the first board 30*a*, the first conductive pattern 231 formed on the accommodation portion 21 of the bas board 20, and the first connection pattern 331 of the first board 30*a*. Thus, the first coil turn forms a path from S to I of FIG. 16.

Referring to FIGS. 16 and 18B, a next second coil turn continuing from the first turn may form a path from I, i.e., the first connection pattern 331 of the first board 30*a*, the last of the first coil turn, to the second conductive pattern 232 of the accommodation portion 21, the connection via 254, the lower conductive pattern 24 of the lower surface of the base board 20, the first through via 251 of the base board 20, and to the second connection pattern 332 of the first board 30*a*. Thus, the second coil turn forms a path from I to F of FIG. 16.

Thus, the first coil according to the present exemplary embodiment is formed as the first coil turn and the second coil turn are alternately disposed and connected into a single coil strand.

The second board 30*b* is similar to the second board 30*b* of FIG. 11. Namely, a conductive pattern 33*b* may be formed on an upper surface of the second board 30*b*, and through vias 35*b* may be formed in both ends of the conductive pattern 33*b*. The conductive patterns 33*b* of the second board 30*b* may be electrically connected to the second and third through vias 252 and 253 of the first board 30*a* through the through vias 35*b*.

The third board 30*c* is laminated on a lower surface of the base board 20. The conductive patterns 33*c* may be formed on the lower surface of the third board 30*c*, and through vias 35*c* may be formed in both ends of the conductive patterns 33*c*. The conductive patterns 33*c* of the third board 30*c* may be electrically connected to the second and third through vias 252 and 253 of the base board 20 through the through vias 35*c*.

Accordingly, the second coil according to the present exemplary embodiment may be formed by the second and third through vias 252 and 253 of the base board 20, the through vias 35*a* and 35*b* formed in the first and second boards 30*a* and 30*b*, and the conductive patterns 33*b* and 33*c* formed on the second and third boards 30*b* and 30*c*.

Here, at least one of the conductive patterns 33*b* of the second board 30*b* and the conductive patterns 33*c* of the third board 30*c* may have an area larger than that of the base board 20 or those of the conductive patterns 23 and 33 of the first board 30*a*.

Also, each of the conductive patterns 33*b* and 33*c* may be connected to a plurality of through vias 35*a*, 35*b*, 252, and 253 (e.g., three through vias). Namely, the plurality of through vias 35*a*, 35*b*, 252, and 253 may connect the conductive pattern 33*b* of the second board 30*b* and the conductive pattern 33*c* of the third board 30*c*.

Accordingly, the second coil according to the present exemplary embodiment encloses the core 70 together with the first coil, and each coil turn of the second coil has an area larger than that of the first coil. Also, in case of the through vias whose area is difficult to increase, a maximum area is secured by connecting a plurality of through vias 252 and 253 to each of the conductive patterns 33*b* and 33*c*.

This purports to reduce leakage occurring in the coil component 600. Namely, the coil component according to the present exemplary embodiment has a structure in which the second coil having an increased area covers the first coil, thus minimizing leakage.

To this end, in the present exemplary embodiment, the conductive patterns 33*b* and 33*c* formed on the second and third boards 30*b* and 30*c* have a width increased outwardly, and have a fan shape. However, a configuration of the present disclosure is not limited thereto and may be variously modified as long as the area of the second coil is increased.

Also, in the present exemplary embodiment, the case in which the second coil has a total of three turns is illustrated as an example. However, a configuration of the present disclosure is not limited thereto and variously modified as needed.

Also, in the coil component 600 according to the present exemplary embodiment, the first coil may include a plurality of independent coils. Referring to FIGS. 16 and 17, in the coil component 600 according to the present exemplary embodiment, the first coil includes two independent coils, for example. In detail, the first coil includes a coil C1 having 40 turns and a coil C2 having a total of 6 turns. When the coil component 600 according to the present exemplary embodiment is used as a transformer, the coil C1 having 40 turns may be used as a primary coil, the coil C2 having 6 turns may be used as an auxiliary coil, and the foregoing second coil may be used as a secondary coil.

Here, the auxiliary coil C2 having 6 turns may obtain an induced electromotive force from power supplied from the primary coil. The auxiliary coil C2 may supply power obtained from the primary coil C1 as a standby power to an electronic device in which the coil component 600 according to the present exemplary embodiment is loaded. Here, the electronic device may be a display device such as a TV, or the like, but the present disclosure is not limited thereto.

Figure 21:
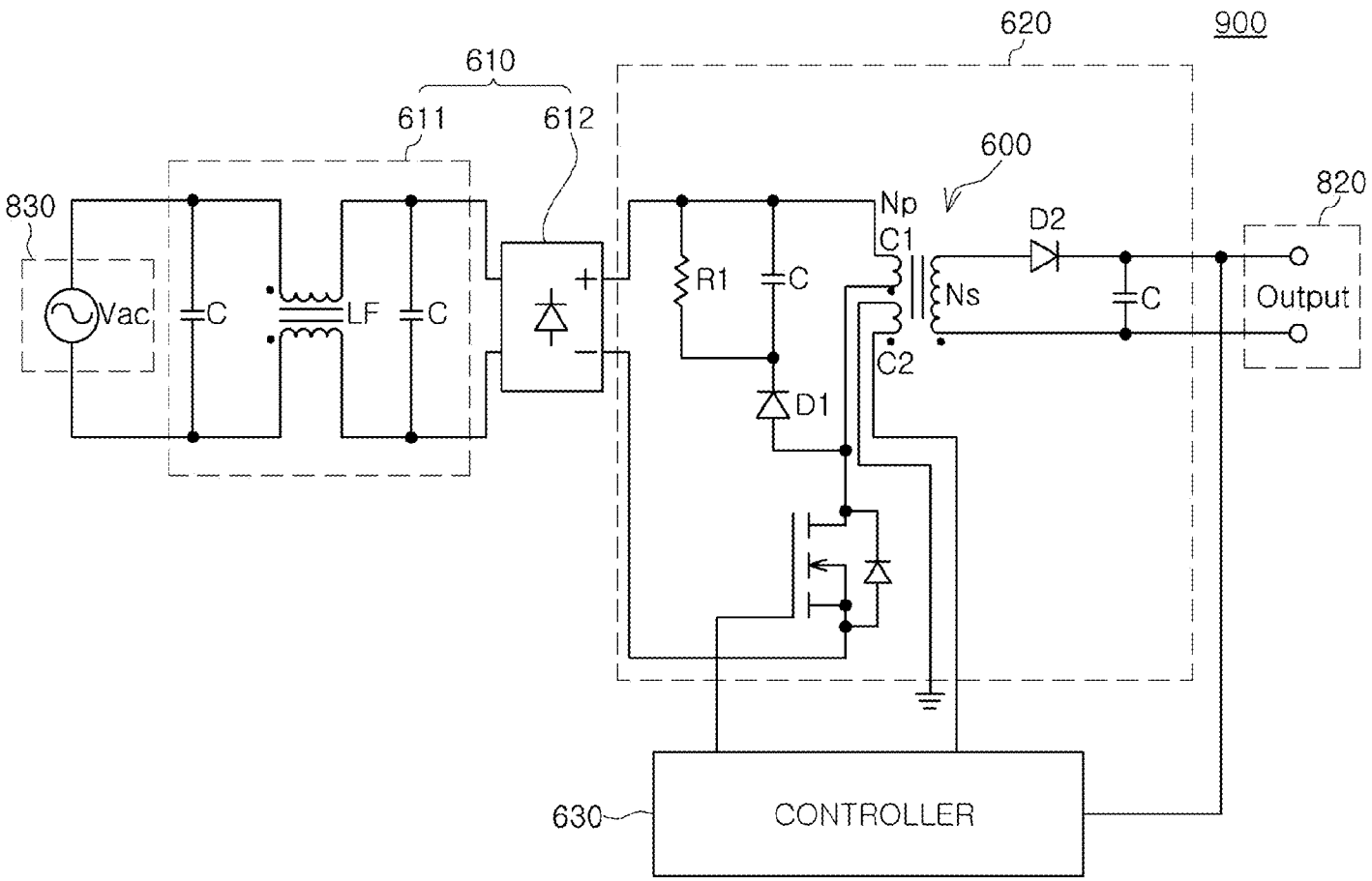
FIG. 21 is a circuit diagram schematically illustrating an electronic module according to an exemplary embodiment of the present disclosure.

Also, in a case in which the coil component 600 is used as a transformer (600 in FIG. 21) of a power adapter, the auxiliary coil C2 may supply a sensing current for sensing a state of a voltage output from the primary coil C1, to a controller (630 in FIG. 21).

Meanwhile, in a case in which the second coil is formed as the first coil (formed on the base board 10 and the first board 30*a*), rather than as the second coil, the number of conductive patterns 23 on the base board 10 needs to be further increased, so the size of the base board 10 needs to be increased.

Thus, in this case, an overall size of the coil component 600 is also increased, increasing the distance between the primary and secondary coils, which results in an increase in leakage of the coil component 600.

However, in the present exemplary embodiment, when the auxiliary coil C2 and the primary coil C1 are formed as first coils and the secondary coil is formed as the second coil formed on the second and third boards 30*b* and 30*c*, the secondary coil is disposed to enclose the primary coil.

Thus, a size of the base board 10 and the coil component 600 may be minimized and a distance between the primary and secondary coils may also be minimized. In addition, leakage of the coil component 600 may be reduced.

In the coil component according to the present exemplary embodiment configured as described above, the first coil is configured by using the conductive patterns formed on the inner side wall of the accommodation portion of the base board and the first through vias formed on the support portion. This configuration is derived as the area of the outer circumferential surface of the support portion is reduced according to a reduction in the size of the coil component.

Namely, in the coil component according to the present exemplary embodiment, only half of overall coil turns are formed on the outer circumferential surface of the support portion, the other half being formed through the first through vias of the support portion. Thus, if there is no space for forming conductive patterns on the outer circumferential surface of the support portion because the coil component is too small, coils may be easily formed.

Also, in the coil component according to the present exemplary embodiment, the secondary coil is wound outside of the primary coil. Also, the secondary coil pattern has an area larger than that of the primary coil.

Thus, since the distance between the primary and secondary coils is minimized, a size of the coil component may be reduced, and thus, leakage may be minimized.

As described above, the coil component according to the present disclosure is not limited to the aforementioned exemplary embodiments and may be variously applied. For example, in the aforementioned exemplary embodiments, a single accommodation portion is formed in a single base board, but the present disclosure is not limited thereto and variously applied as needed. For example, a plurality of accommodation portions may be provided in a single base board and a plurality of cores may be installed therein.

Also, in the present exemplary embodiment, a single conductive pattern is used as a coil strand, but the present disclosure may be variously applied such that a plurality of conductive patterns are connected in parallel and used as a single coil strand, or the like.

Also, in the present exemplary embodiment, a coil component is formed as a single independent component, but the present disclosure is not limited thereto and the coil component may be embedded in a circuit board on which electronic components are mounted. In this case, both a base board and a laminated board may be configured as a portion of the circuit board. Also, since the coil component may be embedded in a circuit board, without being exposed, such that it is integrated with the circuit board, a mounting space may be minimized and an extra mounting process may be omitted.

Figure 19:
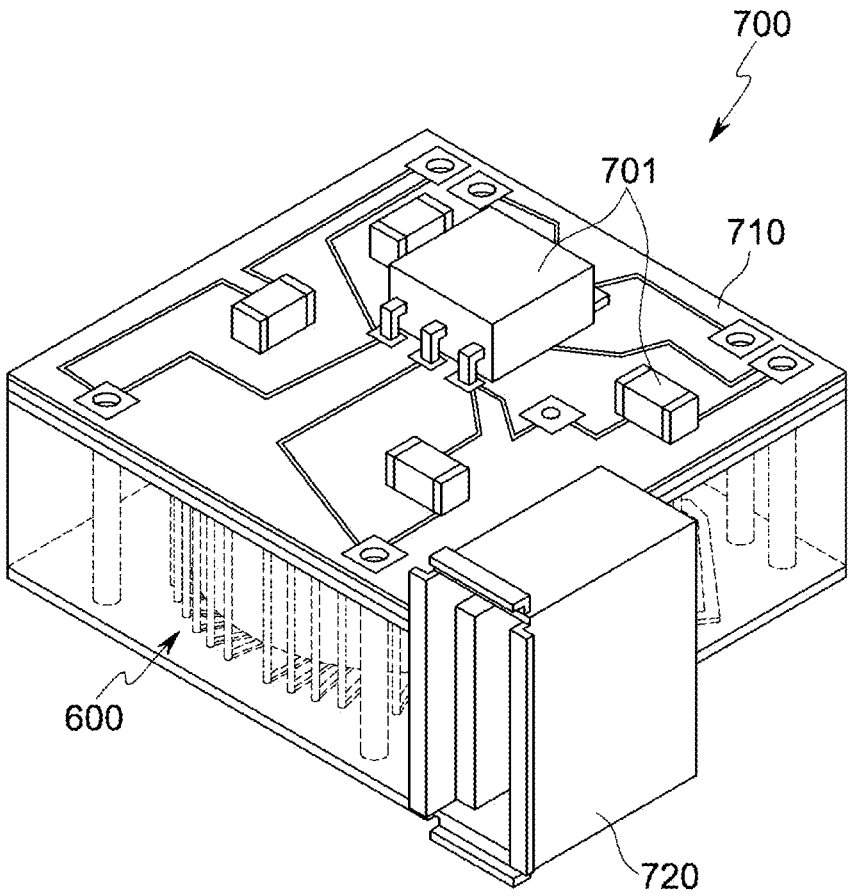
FIG. 19 is a perspective view schematically illustrating an electronic module according to an exemplary embodiment of the present disclosure.

FIG. 19 is a perspective view schematically illustrating an electronic module according to an exemplary embodiment of the present disclosure.

An electronic module 700 according to the present exemplary embodiment may be a module loaded in a charging device converting an alternating current (AC) voltage into a direct current (DC) voltage and supplying the same. The electronic module 700 may include a coil component 600, electronic elements 701, and a connector 720.

As the coil component 600, the coil component 600 illustrated in FIG. 13 may be used.

The electronic elements 701 may be mounted on an external surface of the coil component 600. Here, the electronic elements 701 may include both an active element and a passive element. Also, the electronic elements 701 may include a switching element for controlling an operation of the coil component 600, or an element such as a diode, a capacitor, a resistor, or the like, for transformation or rectification.

Meanwhile, in the present exemplary embodiment, a relay board 710 is laminated on the coil component 600 and electronic elements are mounted on the relay board 710 are mounted. However, the present disclosure is not limited thereto and, as illustrated in FIG. 20, the relay board 710 may be omitted and the electronic elements 701 may be directly mounted on a surface of the coil component, namely, on a second board (30*b* in FIG. 13) of the coil component 600.

The connector 720 may be fastened to any one side of the coil component 600 and electrically connected to the coil component 600. Here, the connector 720 may be a USB connection terminal but the present disclosure is not limited thereto.

Figure 20:
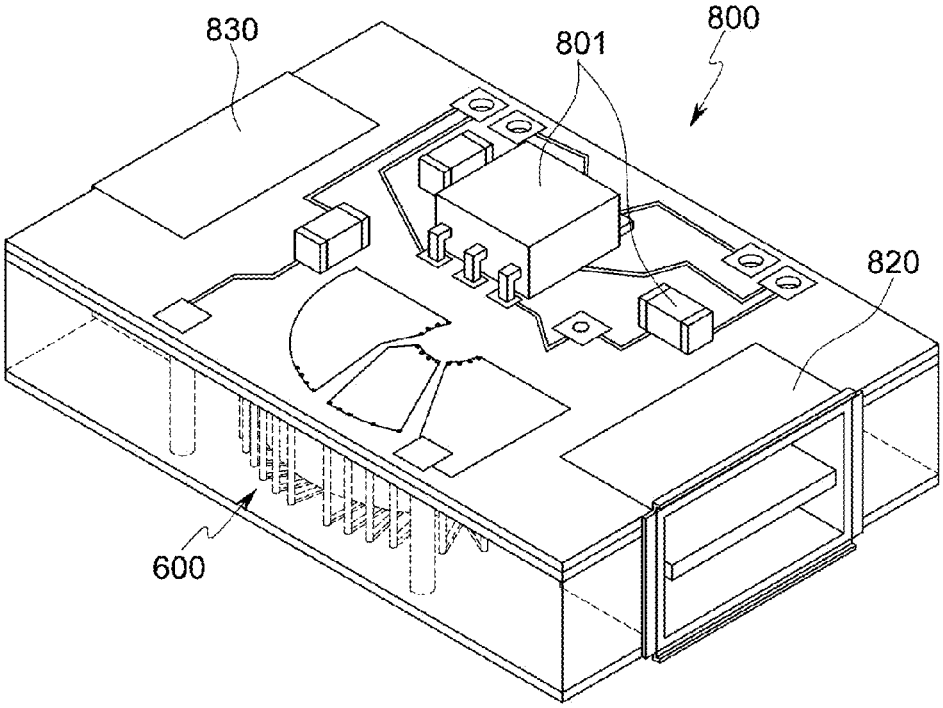
FIG. 20 is a perspective view schematically illustrating an electronic module according to another exemplary embodiment of the present disclosure.

FIG. 20 is a perspective view schematically illustrating an electronic module according to another exemplary embodiment of the present disclosure.

Referring to FIG. 20, an electronic module 800 is similar to that of the aforementioned exemplary embodiment, but different from that of exemplary embodiment in a coupling structure of a connector 820.

In the electronic module 800 according to the present exemplary embodiment, the coil component 600 has recesses formed on both ends thereof, and the connector 820 and a connection terminal 830 are integrally inserted into the recesses.

As mentioned above, the connector 820 may be a USB connection terminal, and the connection terminal 830 may be a terminal to which a cable supplying AC power is connected.

Also, in the electronic module 800 according to the present exemplary embodiment, electronic elements 801 are directly mounted on an outer surface of the coil component 600, namely, on an outer surface of a board assembly. Thus, an electrode pad and a wiring pattern for allowing the electronic elements 801 to be mounted thereon may be added to the outer surface of the coil component 600.

Also, in a case in which the electronic module 800 according to the present exemplary embodiment is used as a module loaded in a charging device or a power adapter, the coil component 600 may be a transformer.

FIG. 21 is a circuit diagram schematically illustrating an electronic module according to an exemplary embodiment of the present disclosure.

Referring to FIG. 21, an electronic module 900 according to the present exemplary embodiment may be a power adapter converting an AC voltage into a DC voltage and supplying the same. The electronic module 900 according to the present exemplary embodiment may include a connector 830, an AC/DC conversion unit 610, a DC/DC conversion unit 620, and a connector 820.

The connection terminal 830 may be a terminal as a connector to which a cable supplying AC power is connected or a terminal to which a cable integrally, fixedly fastened, as mentioned above.

The AC/DC converter 610 switches commercial AC power input from the connection terminal 830 to convert it into DC power.

To this end, the AC/DC converter 610 may include a filter 611 removing electromagnetic interference (EMI) of commercial AC power and a rectifier 612 rectifying and smoothing the AC power which has passed through the filter 611.

The DC/DC converter 620 switches the DC power into a link voltage of DC power and output the same.

To this end, in order to convert DC power into output power, the DC/DC converter 620 may include a transformer 600 including primary and secondary sides, a switching element, and various passive elements.

The connector 820 supplies DC power output from the DC/DC converter 620 to the outside. Thus, an external cable connected to a notebook computer, or the like, may be integrally, fixedly fastened to the connector 820. The connector 820 may be a USB connection terminal to which a USB is inserted.

Meanwhile, the electronic module 900 according to the present exemplary embodiment may further include a controller 630.

The controller 630 may sense a current of a primary coil C1 to estimate a load current of output power and control a link voltage of DC power according to a change in the estimated load current. Thus, characteristics of a load that an output voltage of the output power is increased when the load current of output power is increased may be satisfied. To this end, the controller 630 may include a pulse width modulator, or the like.

Here, in order to sense a current of the primary side C1, the controller 630 may use the foregoing auxiliary coil C2 (C2 in FIG. 17). Namely, the controller 630 may sense a current of the primary coil C1 based on a current induced by the auxiliary coil C2.

The electronic module 900 according to the present exemplary embodiment configured as described above may have the coil components as described above. Namely, the foregoing coil component 600 of FIG. 13 may be used as the transformer 600 of the DC/DC converter 620, and the coil components illustrated in FIGS. 1 through 12 may be used in a filter 611, or the like.

Also, the electronic module 900 according to the present exemplary embodiment may be implemented by mounting the coil components according to the exemplary embodiment of the present disclosure and various electronic elements on a main board (not shown).

However, the present disclosure is not limited thereto and, as illustrated in FIG. 19, various electronic elements 701 may be mounted on one surface of the board 710 and the coil component (600, for example, transformer) according to the present exemplary embodiment may be mounted on the other surface of the board 710.

In particular, as illustrated in FIG. 20, the electronic module 900 according to the present exemplary embodiment may be implemented by embedding all the electronic elements 801 (for example, various passive elements and active elements such as a switching element, a diode, or the like) in the board assembly of the transformer 600 or mounting the electronic elements 801 on an outer surface of the board assembly.

In this case, since a circuit board for mounting electronic elements thereon is not required, the volume of the electronic module may be reduced.

Also, since the coil component having a large volume, like a transformer, is embedded within a board, rather than being disposed on the board, the electronic module may be formed as a subminiature module.

In addition, since electronic elements and connectors are directly mounted on a coil component, the coil components and the other electronic elements are vertically disposed, rather than horizontally. Thus, an overall volume of the module may be minimized.

Moreover, since an electronic module may be manufactured through only a process of manufacturing a coil component and a process of mounting electronic elements and connectors on the coil component, the electronic module may be very easily manufactured, compared to the related art in which a coil component, electronic elements, and connectors are mounted separately.

As set forth above, in a coil component according to exemplary embodiments of the present disclosure, a core is installed within a board assembly. Also, a coil is implemented by conductive patterns formed on a base board and a laminated board.

Thus, since the coil component may be manufactured through a process of preparing the base board, the laminated board, and the core and subsequently coupling them, a manufacturing process is facilitated.

In addition, since the core of the coil component is embedded within the board, a bobbin such as in the related art is not used. Thus, an overall volume of the coil component may be reduced, and thus, the coil component may be easily loaded in a loaded even in a subminiature electronic device.

Also, a coil component having a large volume, like a transformer, is embedded within a board assembly, an electronic module may be formed as a subminiature device. Also, since electronic elements and connectors are directly mounted on a coil component, the coil component and other electronic elements may be disposed vertically, rather than horizontally. Thus, an overall volume of the electronic module may be minimized.

Moreover, since an electronic module may be manufactured through only a process of manufacturing a coil component and a process of mounting electronic elements and connectors on the coil component, the electronic module may be very easily manufactured, compared to the related art in which a coil component, electronic elements, and connectors are mounted separately.

While exemplary embodiments have been shown and described above, it will be apparent to those skilled in the art that modifications and variations could be made without departing from the spirit and scope of the present disclosure as defined by the appended claims.

What is claimed is:

1. A coil component comprising:

a base board having an accommodation portion and conductive patterns disposed within the accommodation portion;

a core disposed in the accommodation portion, wherein the core has a gap which is a cut portion of the core and the base board includes an insertion protrusion formed within the accommodation portion to fix a position of the core gap; and a laminated board laminated on the base board and having conductive patterns disposed on one surface thereof, wherein the conductive patterns of the laminated board are connected to the conductive patterns of the base board to form a coil.

2. A coil component comprising:

a base board having an accommodation portion and conductive patterns disposed within the accommodation portion;

a core disposed in the accommodation portion, wherein the core has a gap which is a cut portion of the core; and a laminated board laminated on the base board and having conductive patterns disposed on one surface thereof, wherein the conductive patterns of the laminated board are connected to the conductive patterns of the base board for form a coil, and wherein the base board includes at least one core guide defining an insertion position of the core within the accommodation portion, and an insertion protrusion protrudes from the core guide and is inserted into the gap of the core.

3. The coil component of claim 2, wherein the core guide is disposed on the corner between a side wall of the accommodation portion and a bottom surface of the accommodation portion.

4. The coil component of claim 3, wherein the core guide has an 'L' shape.

5. The coil component of claim 2, wherein the core guide protrudes from a side wall of the accommodation portion or a bottom surface of the accommodation portion.

6. The coil component of claim 5, wherein the core guide has a shape having a width that reduces towards an upper end thereof.

7. The coil component of claim 2, wherein a plurality of core guides are disposed to be spaced apart from one another at equal intervals.

8. The coil component of claim 2, wherein the core guide protrudes between the conductive patterns radially disposed on the accommodation portion.

9. A coil component comprising:

a base board having an accommodation portion and conductive patterns disposed within the accommodation portion;

a core disposed in the accommodation portion, wherein the core has a gap which is a cut portion of the core;

a barrier inserted into the gap of the core and coupled within the accommodation portion to fix the core to the accommodation portion; and a laminated board laminated on the base board and having conductive patterns disposed on one surface thereof, where the conductive patterns of the laminated board are connected to the conductive patterns of the base board to form a coil.

10. The coil component of claim 9, wherein the base board includes an insertion recess within the accommodation portion and allowing the barrier to be coupled thereto.

11. A coil component comprising:

a board assembly having an accommodation portion and conductive patterns disposed on an inner surface of the accommodation portion; and a core embedded in the accommodation portion, wherein at least one core guide is disposed within the accommodation portion to secure a space by which the core is separated from the conductive patterns; and wherein the core has a gap which is a cut portion of the core, and the board assembly includes an insertion protrusion formed within the accommodation portion to fix a position of the core gap.

12. The coil component of claim 11, wherein the board assembly comprises:

a base board having the accommodation portion disposed therein; and a laminated board laminated on the base board to embed the core therein.

13. The coil component of claim 11, wherein the board assembly includes at least one conductive pattern having a coil shape wound around the core.

14. The coil component of claim 13, wherein the board assembly includes at least one external terminal disposed on any one surface thereof, electrically connected to the conductive patterns and electrically and physically connected to the outside.

15. The coil component of claim 11, wherein the interior of the accommodation portion is filled with an insulating material.

* * * * *